US011885051B2

(12) United States Patent
Quick et al.

(10) Patent No.: US 11,885,051 B2
(45) Date of Patent: Jan. 30, 2024

(54) BRAIDING MACHINE AND METHODS OF USE

(71) Applicant: Inceptus Medical, LLC, Aliso Viejo, CA (US)

(72) Inventors: Richard Quick, Mission Viejo, CA (US); John Coleman Thress, Capistrano Beach, CA (US); Greg Ulrich, Laguna Woods, CA (US)

(73) Assignee: Inceptus Medical, LLC, Aliso Viejo, CA (US)

( * ) Notice: Subject to any disclaimer, the term of this patent is extended or adjusted under 35 U.S.C. 154(b) by 493 days.

(21) Appl. No.: 16/754,830

(22) PCT Filed: Oct. 13, 2018

(86) PCT No.: PCT/US2018/055780

§ 371 (c)(1),
(2) Date: Apr. 9, 2020

(87) PCT Pub. No.: WO2019/075444

PCT Pub. Date: Apr. 18, 2019

(65) Prior Publication Data

US 2020/0240056 A1 Jul. 30, 2020

Related U.S. Application Data

(60) Provisional application No. 62/572,462, filed on Oct. 14, 2017.

(51) Int. Cl.
*D04C 3/06* (2006.01)
*D04C 3/30* (2006.01)

(52) U.S. Cl.
CPC ..... *D04C 3/06* (2013.01); *D04C 3/30* (2013.01)

(58) Field of Classification Search
CPC ... D04C 3/06; D04C 3/30; D04C 3/04; D04C 3/24; D04C 3/40; D04C 3/48; D04C 3/44;
(Continued)

(56) References Cited

U.S. PATENT DOCUMENTS 290,624 A * 12/1883 Barnes et al. ..... D04C 3/38 87/37
681,998 A * 9/1901 Swift ..... D04C 3/38 87/18

(Continued)

FOREIGN PATENT DOCUMENTS

CN 101687088 3/2010
CN 102119040 7/2011

(Continued)

OTHER PUBLICATIONS

Yordan Kyosev, Braiding technology for textiles: Principles, design and processes, Jan. 2014, Woodhead, chapter 6, pp. 115-151. (Year: 2014).*

(Continued)

*Primary Examiner* — Bao-Thieu L Nguyen
*Assistant Examiner* — Uyen T Nguyen
(74) *Attorney, Agent, or Firm* — Perkins Coie LLP

(57) ABSTRACT

Systems and methods for forming a tubular braid are disclosed here-in. A braiding system configured in accordance with embodiments of the present technology can include, for example, an upper drive unit, a lower drive unit, a mandrel coaxial with the upper and lower drive units, and a plurality of tubes extending between the upper drive unit and the lower drive unit. Each tube can be configured to receive individual filaments for forming the tubular braid, and the upper and lower drive units can act in synchronization to move the tubes (and the filaments contained within those (Continued)

tubes) in three distinct motions: (i) radially inward toward a central axis, (ii) radially outward away from the central axis, and (iii) rotationally about the central axis, to cross the filaments over and under one another to form the tubular braid on the mandrel.

13 Claims, 11 Drawing Sheets

(58) Field of Classification Search
CPC ... D04C 3/02; D04C 3/00; D04C 3/08; D04C 3/14; D04C 3/18; D04C 3/10; D04C 3/22; D04C 3/36; D04C 3/38; D04C 3/16; D04C 3/20; D04C 3/26; D04C 3/42
USPC ..... 87/9, 34
See application file for complete search history.

(56) References Cited

U.S. PATENT DOCUMENTS 787,383 A * 4/1905 Klein ..... D04C 3/40 87/41
3,088,363 A 5/1963 Sparks
3,892,161 A 7/1975 Sokol
4,034,642 A 7/1977 Iannucci et al.
4,287,808 A 9/1981 Leonard et al.
4,312,261 A 1/1982 Florentine
4,535,674 A * 8/1985 Bull ..... D04C 3/48 87/48
4,719,837 A 1/1988 McConnell et al.
4,881,444 A 11/1989 Krauland
4,885,973 A 12/1989 Spain
4,916,997 A 4/1990 Spain
5,301,596 A 4/1994 Huey, Jr.
5,702,421 A 12/1997 Schneidt
5,725,552 A 3/1998 Kotula et al.
5,733,294 A 3/1998 Forber et al.
5,741,332 A 4/1998 Schmitt
5,749,858 A 5/1998 Cramer
5,800,525 A 9/1998 Bachinski et al.
5,827,304 A 10/1998 Hart
5,861,003 A 1/1999 Latson et al.
5,944,738 A 8/1999 Amplatz et al.
5,974,938 A 11/1999 Lloyd
5,976,174 A 11/1999 Ruin
6,254,571 B1 7/2001 Hart
6,331,184 B1 12/2001 Abrams
6,346,117 B1 2/2002 Greenhalgh
6,375,668 B1 4/2002 Gifford et al.
6,458,139 B1 10/2002 Parmer et al.
6,468,303 B1 10/2002 Amplatz et al.
6,495,227 B1 * 12/2002 Cahuzac ..... B29C 70/22 138/123
6,511,492 B1 1/2003 Rosenbluth et al.
6,554,849 B1 4/2003 Jones et al.
6,635,068 B1 10/2003 Dubrul et al.
6,893,458 B2 5/2005 Cox et al.
6,932,830 B2 8/2005 Ungs
6,994,092 B2 2/2006 Van Der Burg et al.
7,048,014 B2 5/2006 Hyodoh et al.
7,069,835 B2 7/2006 Nishri et al.
7,128,073 B1 10/2006 Van Der Burg et al.
7,313,505 B2 12/2007 Brown
7,500,345 B2 3/2009 Kish
7,727,189 B2 6/2010 Vantassel et al.
7,922,732 B2 4/2011 Mazzocchi et al.
8,034,061 B2 10/2011 Amplatz et al.
8,246,641 B2 8/2012 Osborne et al.
8,261,648 B1 9/2012 Marchand et al.
8,361,138 B2 1/2013 Adams
8,398,670 B2 3/2013 Amplatz et al.
8,430,012 B1 4/2013 Marchand et al.
8,454,633 B2 6/2013 Amplatz et al.
8,534,176 B2 9/2013 Giszter et al.
8,641,777 B2 2/2014 Strauss et al.
8,690,907 B1 4/2014 Janardhan et al.
8,715,316 B1 5/2014 Janardhan et al.
8,747,432 B1 6/2014 Janardhan et al.
8,758,389 B2 6/2014 Glimsdale
8,764,787 B2 7/2014 Ren
8,820,207 B2 9/2014 Marchand et al.
8,821,529 B2 9/2014 Kariniemi et al.
8,826,791 B2 9/2014 Thompson et al.
8,833,224 B2 9/2014 Thompson et al.
8,852,205 B2 10/2014 Brady et al.
8,961,556 B2 2/2015 Amplatz et al.
9,039,724 B2 5/2015 Amplatz et al.
9,078,658 B2 7/2015 Hewitt et al.
9,179,899 B2 11/2015 Freudenthal
9,179,920 B2 11/2015 Ren
9,259,237 B2 2/2016 Quick et al.
9,528,205 B2 12/2016 Thompson et al.
9,681,876 B2 6/2017 Cragg et al.
9,743,918 B2 8/2017 Amplatz et al.
9,765,457 B2 9/2017 Tahara et al.
9,770,232 B2 9/2017 Amin et al.
9,844,382 B2 12/2017 Aboytes et al.
9,861,346 B2 1/2018 Callaghan
9,861,467 B2 1/2018 Cully et al.
9,913,652 B2 3/2018 Bridgeman et al.
9,994,980 B2 6/2018 Quick
10,376,267 B2 8/2019 Lubock et al.
10,577,733 B2 3/2020 Quick
11,304,701 B2 4/2022 Lubock et al.
11,346,027 B2 5/2022 Quick
2001/0025563 A1 * 10/2001 Bettger ..... D04C 3/38 87/33
2002/0072765 A1 6/2002 Mazzocchi et al.
2002/0123802 A1 9/2002 Snyders
2002/0165572 A1 11/2002 Saadat
2003/0139802 A1 7/2003 Wulfman et al.
2003/0181942 A1 9/2003 Sutton et al.
2003/0187473 A1 10/2003 Berenstein et al.
2003/0204249 A1 10/2003 Letort
2004/0073243 A1 4/2004 Sepetka et al.
2004/0176798 A1 9/2004 Epstein et al.
2004/0215167 A1 10/2004 Belson
2004/0215230 A1 10/2004 Frazier et al.
2004/0254633 A1 12/2004 Rapaport et al.
2005/0039769 A1 * 2/2005 Bousfield ..... D04C 3/06 132/271
2005/0113861 A1 5/2005 Corcoran et al.
2005/0119668 A1 6/2005 Teague et al.
2005/0119682 A1 6/2005 Nguyen et al.
2005/0137692 A1 6/2005 Haug et al.
2005/0228434 A1 10/2005 Amplatz et al.
2005/0267493 A1 12/2005 Schreck et al.
2005/0283224 A1 12/2005 King
2006/0079930 A1 4/2006 McGuckin, Jr. et al.
2006/0129222 A1 6/2006 Stinson
2006/0247680 A1 11/2006 Amplatz et al.
2006/0265054 A1 11/2006 Greenhalgh et al.
2006/0293706 A1 12/2006 Shimon
2007/0005103 A1 1/2007 Schaeffer
2007/0027534 A1 2/2007 Bergheim et al.
2007/0093744 A1 4/2007 Elmaleh
2007/0106311 A1 5/2007 Wallace et al.
2007/0118165 A1 5/2007 DeMello et al.
2007/0129791 A1 6/2007 Balaji
2007/0161963 A1 7/2007 Smalling
2007/0185500 A1 8/2007 Martin et al.
2007/0208376 A1 9/2007 Meng
2007/0208412 A1 9/2007 Elmaleh
2007/0265656 A1 11/2007 Amplatz et al.
2008/0140110 A1 6/2008 Spence
2008/0200945 A1 8/2008 Amplatz et al.
2008/0262472 A1 10/2008 Lunn et al.
2009/0062841 A1 3/2009 Amplatz et al.
2009/0082803 A1 3/2009 Adams et al.
2009/0099647 A1 4/2009 Glimsdale et al.
2009/0112251 A1 4/2009 Qian et al.
2009/0112309 A1 4/2009 Jaramillo et al.
2009/0171386 A1 7/2009 Amplatz et al.

(56) References Cited

U.S. PATENT DOCUMENTS

| | | | | |
|---|---|---|---|---|
| 2009/0209855 | A1 | 8/2009 | Drilling et al. | |
| 2009/0222076 | A1 | 9/2009 | Figulla et al. | |
| 2009/0254172 | A1 | 10/2009 | Grewe | |
| 2009/0275974 | A1 | 11/2009 | Marchand et al. | |
| 2010/0023048 | A1 | 1/2010 | Mach | |
| 2010/0030244 | A1 | 2/2010 | Woolfson et al. | |
| 2010/0036474 | A1 | 2/2010 | Bergheim | |
| 2010/0076482 | A1 | 3/2010 | Shu et al. | |
| 2010/0114152 | A1 | 5/2010 | Shukla | |
| 2010/0168785 | A1 | 7/2010 | Parker | |
| 2010/0211046 | A1 | 8/2010 | Adams et al. | |
| 2010/0256723 | A1 | 10/2010 | Murray | |
| 2010/0305604 | A1 | 12/2010 | Pah | |
| 2010/0324588 | A1 | 12/2010 | Miles et al. | |
| 2011/0146361 | A1 | 6/2011 | Davidson et al. | |
| 2011/0152993 | A1 | 6/2011 | Marchand et al. | |
| 2011/0160742 | A1 | 6/2011 | Ferrera et al. | |
| 2011/0160753 | A1 | 6/2011 | Bastin | |
| 2011/0208234 | A1 | 8/2011 | Mazzocchi et al. | |
| 2011/0277618 | A1 | 11/2011 | Giszter et al. | |
| 2011/0301630 | A1 | 12/2011 | Hendriksen et al. | |
| 2012/0006187 | A1 | 1/2012 | Emmerich | |
| 2012/0022639 | A1 | 1/2012 | Hacohen et al. | |
| 2012/0143242 | A1 | 6/2012 | Masters | |
| 2012/0283768 | A1 | 11/2012 | Cox et al. | |
| 2012/0323267 | A1 | 12/2012 | Ren | |
| 2012/0330347 | A1 | 12/2012 | Becking et al. | |
| 2013/0060323 | A1 | 3/2013 | McHugo | |
| 2013/0092012 | A1 | 4/2013 | Marchand et al. | |
| 2013/0092013 | A1 | 4/2013 | Thompson et al. | |
| 2013/0096606 | A1 | 4/2013 | Bruchman et al. | |
| 2013/0110153 | A1 | 5/2013 | Wang et al. | |
| 2013/0226223 | A1 | 8/2013 | Spenser | |
| 2013/0239790 | A1* | 9/2013 | Thompson | D04C 1/12 87/9 |
| 2013/0282054 | A1 | 10/2013 | Osypka | |
| 2014/0005713 | A1 | 1/2014 | Bowman | |
| 2014/0005714 | A1 | 1/2014 | Quick et al. | |
| 2014/0052170 | A1 | 2/2014 | Heuser et al. | |
| 2014/0107694 | A1 | 4/2014 | Wang | |
| 2014/0135810 | A1 | 5/2014 | Divino et al. | |
| 2014/0303667 | A1 | 10/2014 | Cox et al. | |
| 2014/0303719 | A1 | 10/2014 | Cox et al. | |
| 2014/0318354 | A1 | 10/2014 | Thompson et al. | |
| 2014/0318355 | A1 | 10/2014 | Marchand et al. | |
| 2014/0324091 | A1 | 10/2014 | Rosenbluth et al. | |
| 2014/0330299 | A1 | 11/2014 | Rosenbluth et al. | |
| 2014/0330305 | A1 | 11/2014 | Rood et al. | |
| 2014/0343602 | A1 | 11/2014 | Cox et al. | |
| 2014/0364897 | A1 | 12/2014 | Myla | |
| 2015/0018860 | A1 | 1/2015 | Quick et al. | |
| 2015/0032148 | A1 | 1/2015 | Golan | |
| 2015/0039016 | A1 | 2/2015 | Naor et al. | |
| 2015/0039017 | A1 | 2/2015 | Cragg et al. | |
| 2015/0133989 | A1 | 5/2015 | Lubock et al. | |
| 2015/0196301 | A1 | 7/2015 | Bodewadt et al. | |
| 2015/0223829 | A1 | 8/2015 | Aboytes | |
| 2015/0257763 | A1 | 9/2015 | Blum et al. | |
| 2015/0275408 | A1 | 10/2015 | Tahara et al. | |
| 2015/0374391 | A1 | 12/2015 | Quick et al. | |
| 2016/0015398 | A1 | 1/2016 | Hewitt et al. | |
| 2016/0022270 | A1 | 1/2016 | Watson et al. | |
| 2016/0045211 | A1 | 2/2016 | Janardhan et al. | |
| 2016/0128822 | A1 | 5/2016 | Tejani | |
| 2016/0151141 | A1 | 6/2016 | Zimmerman | |
| 2016/0206321 | A1 | 7/2016 | Connor | |
| 2017/0007260 | A1 | 1/2017 | O'Brien et al. | |
| 2017/0014114 | A1 | 1/2017 | Rafiee et al. | |
| 2017/0014115 | A1 | 1/2017 | Rafiee et al. | |
| 2017/0037548 | A1* | 2/2017 | Lee | D04C 3/32 |
| 2017/0088988 | A1 | 3/2017 | Thompson et al. | |
| 2017/0119400 | A1 | 5/2017 | Amplatz et al. | |
| 2017/0224355 | A1 | 8/2017 | Bowman et al. | |
| 2017/0233908 | A1 | 8/2017 | Kroczynski et al. | |
| 2018/0028312 | A1 | 2/2018 | Thill et al. | |
| 2018/0105963 | A1 | 4/2018 | Quick | |
| 2018/0242980 | A1 | 8/2018 | Lubock et al. | |
| 2018/0274141 | A1 | 9/2018 | Quick | |
| 2019/0307464 | A1 | 10/2019 | Lubock et al. | |
| 2020/0261098 | A1 | 8/2020 | Lubock et al. | |
| 2020/0270784 | A1 | 8/2020 | Quick | |
| 2022/0031335 | A1 | 2/2022 | Lubock et al. | |
| 2022/0251744 | A1 | 8/2022 | Quick | |

FOREIGN PATENT DOCUMENTS

| | | | |
|---|---|---|---|
| CN | 102362023 | A | 2/2012 |
| CN | 103874794 | A | 6/2014 |
| CN | 103911744 | | 7/2014 |
| CN | 103975101 | A | 8/2014 |
| CN | 106436007 | A | 2/2017 |
| CN | 110100052 | A | 8/2019 |
| DE | 202008001829 | | 7/2008 |
| EP | 1849440 | | 7/2011 |
| EP | 2932921 | | 10/2015 |
| GB | 231065 | | 3/1925 |
| JP | S57-101674 | | 1/1984 |
| JP | H5-19219 | | 10/1994 |
| JP | 2014532127 | | 12/2014 |
| WO | WO9601591 | | 1/1996 |
| WO | WO9916382 | | 4/1999 |
| WO | WO0027292 | | 5/2000 |
| WO | WO0043062 | | 7/2000 |
| WO | WO2006074032 | | 7/2006 |
| WO | WO2006128193 | | 11/2006 |
| WO | WO2008066881 | | 6/2008 |
| WO | WO2008150346 | | 12/2008 |
| WO | WO2009014528 | | 1/2009 |
| WO | WO2010006061 | | 1/2010 |
| WO | WO2011027002 | | 3/2011 |
| WO | WO2011057002 | | 5/2011 |
| WO | WO2011057087 | | 5/2011 |
| WO | WO2013028579 | | 2/2013 |
| WO | WO2013074486 | | 5/2013 |
| WO | WO2013104721 | | 7/2013 |
| WO | WO2016045987 | | 3/2016 |
| WO | WO2018071880 | | 4/2018 |
| WO | WO2018156962 | | 8/2018 |
| WO | WO2019075444 | | 4/2019 |

OTHER PUBLICATIONS

International Search Report and Written Opinion for Application PCT/US12/43885. dated Dec. 26, 2012, 14 pages.

International Search Report and Written Opinion for Application PCT/US12/51502. dated Oct. 25, 2012, 11 pages.

International Search Report and Written Opinion for Application PCT/US12/67479. dated Feb. 25, 2013, 12 pages.

International Search Report and Written Opinion for Application PCT/US13/20381. dated Apr. 8, 2013, 13 pages.

International Search Report and Written Opinion for Application PCT/US13/37484. dated Sep. 12, 2013, 12 pages.

International Search Report and Written Opinion for International Application No. PCT/US2014/029210, dated Aug. 12, 2014, 15 pages.

Schmitz-Rode et al., "Temporary Pulmonary Stent Placement as Emergency Treatment of Pulmonary Embolism," Journal of the American College of Cardiology, vol. 48, No. 4, 2006 (5 pgs.).

Turk et al., "Adapt Fast study: a direct aspiration first pass technique for acute stroke thrombectomy." J NeuroIntervent Surg, vol. 6, 2014, 6 pages.

Lewin, "Medical Device Innovation in America: Tensions Between Food and Drug Law and Patent Law," Harvard Journal of Law and Technology, vol. 26, No. 1, Fall 2012, 25 pages.

International Search Report and Written Opinion for PCT Application No. PCT/US17/56692, Applicant: Inceptus Medical, LLC, dated Jan. 25, 2018, 16 pages.

Ross et al, "The Vascular Plug: A New Device for Parent Artery Occlusion," American Journal of Neuroradiology, Feb. 2007, pp. 385-386.

(56) References Cited

OTHER PUBLICATIONS

Gandhi et al., "The MVP Micro Vascular Plug: A new Paradigm in Peripheral Embolization," Insert to Endovascular Today, Apr. 2015, pp. 80-84.
International Search Report for International Application No. PCT/US2018/019532, filed Feb. 23, 2018; Applicant: Inceptus Medical, LLC; dated Jun. 27, 2018, 5 pages.
Written Opinion for International Application No. PCT/US2018/019532, filed Feb. 23, 2018; Applicant: Inceptus Medical, LLC; dated Jun. 27, 2018, 8 pages.
Barwad et al, "Amplatzer Vascular Plugs in Congenital Cardiovascular Malformations," Annals of Pediatric Cardiology 2013, vol. 6, Issue 2, Date of Web Publication: Jul. 20, 2013, 9 pages.
Sharafuddin et al, "Experimental Comparison with Standard Gianturco Coils," From the Department of Radiology, University of Minnesota Hospital and Clinic, 420 Delaware St, SE, Minneapolis, MN 55455; from the 1996 SCVIR annual meeting. Received Apr. 30, 1996; revision requested Jun. 6; revision received and accepted Jun. 19, 1996, 9 pages.
International Search Report and Written Opinion for International Application No. PCT/US2018/055780, filed Oct. 13, 2018; Applicant: Inceptus Medical, LLC; dated Jan. 22, 2019, 8 pages.
Extended European Search Report received for EP Application No. 18866481.7, Applicant: Inceptus Medical, LLC, dated Jun. 7, 2021, 11 pages.
English Translation of Japanese Office Action received for Application No. 2020-521337, Applicant: Inceptus Medical, LLC, dated Apr. 13, 2023, 4 pages.
English Translation of Japanese Office Action received for Application No. 2020-521337, Applicant: Inceptus Medical, LLC, dated Oct. 3, 2022, 5 pages.

* cited by examiner

BRAIDING MACHINE AND METHODS OF USE

CROSS-REFERENCE TO RELATED APPLICATIONS

This application is a 35 U.S.C. § 371 U.S. National Phase application of International Patent Application No. PCT/US2018/055780, titled "BRAIDING MACHINE AND METHODS OF USE," filed Oct. 13, 2018, which claims the benefit of U.S. Provisional Patent Application No. 62/572,462, titled "BRAIDING MACHINE AND METHODS OF USE," filed Oct. 14, 2017, the contents of which are hereby incorporated by reference in their entireties.

TECHNICAL FIELD

The present technology relates generally to systems and methods for forming a tubular braid of filaments. In particular, some embodiments of the present technology relate to systems for forming a braid through the movement of vertical tubes, each housing a filament, in a series of discrete radial and arcuate paths around a longitudinal axis of a mandrel.

BACKGROUND

Braids generally comprise many filaments interwoven together to form a cylindrical or otherwise tubular structure. Such braids have a wide array of medical applications. For example, braids can be designed to collapse into small catheters for deployment in minimally invasive surgical procedures. Once deployed from a catheter, some braids can expand within the vessel or other bodily lumen in which they are deployed to, for example, occlude or slow the flow of bodily fluids, to trap or filter particles within a bodily fluid, or to retrieve blood clots or other foreign objects in the body.

Some known machines for forming braids operate by moving spools of wire such that the wires paid out from each spool cross over/under one another. However, these braiding machines are not suitable for most medical applications that require braids constructed of very fine wires that have a low tensile strength. In particular, as the wires are paid out from the spools they can be subject to large impulses that may break the wires. Other known braiding machines secure a weight to each wire to tension the wires without subjecting them to large impulses during the braiding process. These machines then manipulate the wires using hooks other means for gripping the wires to braid the wires over/under each other. One drawback with such braiding machines is that they tend to be very slow, since the weights need time to settle after each movement of the filaments. Moreover, since braids have many applications, the specifications of their design—such as their length, diameter, pore size, etc.—can vary greatly. Accordingly, it would be desirable to provide a braiding machine capable of forming braids with varying dimensions, using very thin filaments, and at high speed.

BRIEF DESCRIPTION OF THE DRAWINGS

Many aspects of the present disclosure can be better understood with reference to the following drawings. The components in the drawings are not necessarily to scale. Instead, emphasis is placed on illustrating clearly the principles of the present disclosure.

DETAILED DESCRIPTION

The present technology is generally directed to systems and methods for forming a braided structure from a plurality of filaments. In some embodiments, a braiding system according to present technology can include an upper drive unit, a lower drive unit coaxially aligned with the upper drive unit along a central axis, and a plurality of tubes extending between the upper and lower drive units and constrained within the upper and lower drive units. Each tube can receive the end of an individual filament attached to a weight. The filaments can extend from the tubes to a mandrel aligned with the central axis. In certain embodiments, the upper and lower drive units can act in synchronization to move the tubes (and the filaments contained within those tubes) in three distinct motions: (i) radially inward toward the central axis, (ii) radially outward away from the central axis, and (iii) rotationally about the central axis. In certain embodiments, the upper and lower drive units simultaneously move a first set of the tubes radially outward and move a second set of the tubes radially inward to "pass" the filaments contained with those tubes. The upper and lower drive units can further move the first of tubes—and the filaments held therein—past the second set of tubes to form, for example, an "over/under" braided structure on the mandrel. Because the wires are contained within the tubes and the upper and lower drive units act in synchronization upon both the upper and lower portion of the tubes, the tubes can be rapidly moved past each other to form the braid. This is a significant improvement over systems that do not move both the upper and lower portions of the tubes in synchronization. Moreover, the present systems permit for very fine filaments to be used to form the braid since tension is provided using a plurality of weights. The filaments are therefore not subject to large impulse forces during the braiding process that may break them.

As used herein, the terms "vertical," "lateral," "upper," and "lower" can refer to relative directions or positions of features in the braiding systems in view of the orientation shown in the Figures. For example, "upper" or "uppermost"

can refer to a feature positioned closer to the top of a page than another feature. These terms, however, should be construed broadly to include semiconductor devices having other orientations, such as inverted or inclined orientations where top/bottom, over/under, above/below, up/down, and left/right can be interchanged depending on the orientation.

Figure 1:
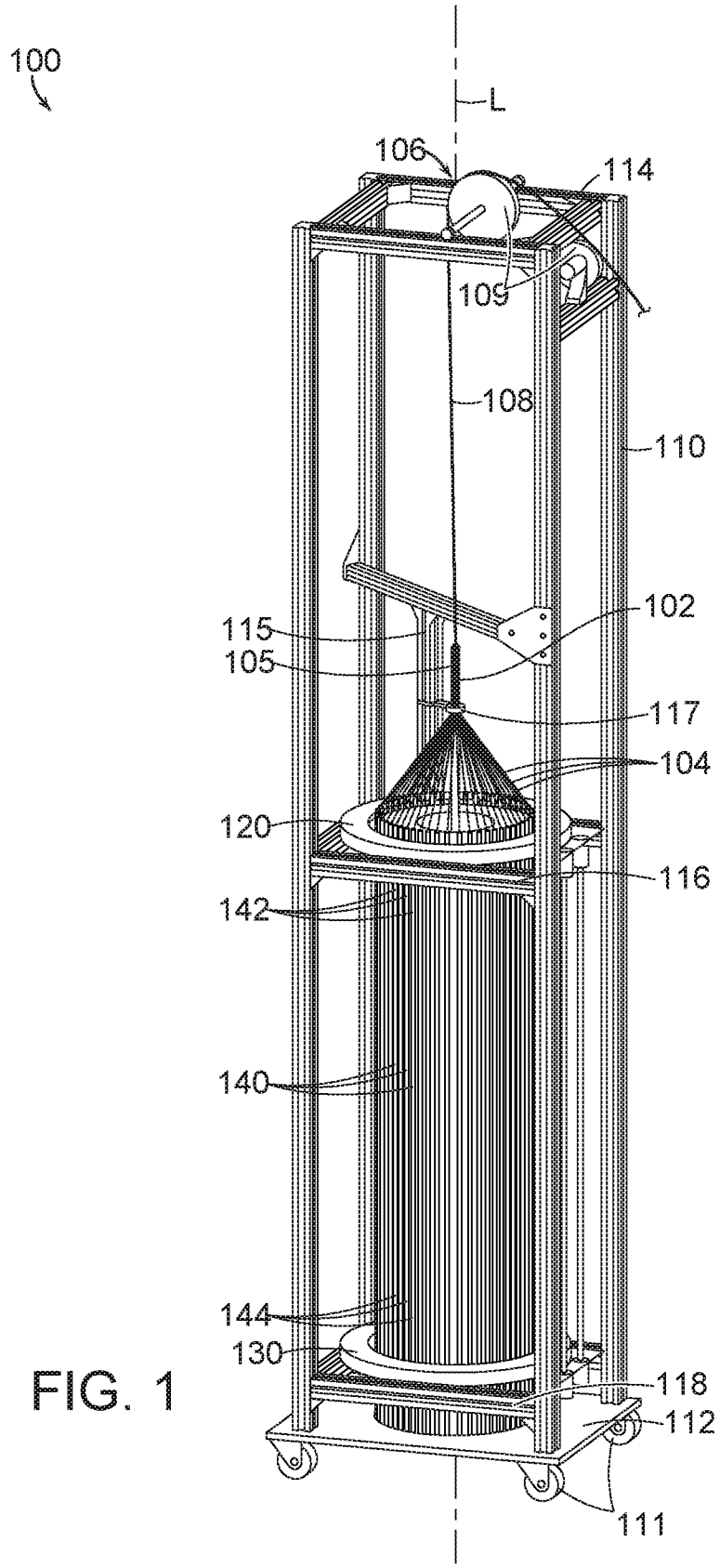
FIG. 1 is an isometric view of a braiding system configured in accordance with embodiments of the present technology.

FIG. 1 is an isometric of a braiding system 100 ("system 100") configured in accordance with the present technology. The system 100 includes a frame 110, an upper drive unit 120 coupled to the frame 110, a lower drive unit 130 coupled to the frame 110, a plurality of tubes 140 (e.g., elongate housings) extending between the upper and lower drive units 120, 130 (collectively "drive units 120, 130"), and a mandrel 102. In some embodiments, the drive units 120, 130 and the mandrel 102 are coaxially aligned along a central axis L (e.g., a longitudinal axis). In the embodiment illustrated in FIG. 1, the tubes 140 are arranged symmetrically with respect to the central axis L with their longitudinal axes parallel to the central axis L. As shown, the tubes 140 are arranged in a circular array about the central axis L. That is, the tubes 140 can each be spaced equally radially from the central axis L, and can collectively form a cylindrical shape. In other embodiments, the tubes 140 can be arranged in a conical shape such that the longitudinal axes of the tubes 140 are angled with respect to and intersect the central axis L. In yet other embodiments, the tubes 140 can be arranged in a "twisted" shape in which the longitudinal axes of the tubes 140 are angled with respect to the central axis L, but do not intersect the central axis L (e.g., the top ends of the tubes can be angularly offset from the bottom ends of the tubes with respect the central axis L).

The frame 110 can generally comprise a metal (e.g., steel, aluminum, etc.) structure for supporting and housing the components of the system 100. More particularly, for example, the frame 110 can include an upper support structure 116 that supports the upper drive unit 120, a lower support structure 118 that supports the lower drive unit 130, a base 112, and a top 114. In some embodiments, the drive units 120, 130 are directly attached (e.g., via bolts, screws, etc.) to the upper and lower support structures 116, 118, respectively. In some embodiments, the base 112 can be configured to support all or a portion of the tubes 140. In the embodiment illustrated in FIG. 1, the system 100 includes wheels 111 coupled to the base 112 of the frame 110 and can, accordingly, be a portable system. In other embodiments, the base 112 can be permanently attached to a surface (e.g., a floor) such that the system 100 is not portable.

The system 100 operates to braid filaments 104 loaded to extend radially from the mandrel 102 to the tubes 140. As shown, each tube 140 can receive a single filament 104 therein. In other embodiments, only a subset of the tubes 140 receive a filament. In some embodiments, the total number of filaments 104 is one half the total number of tubes 140 that house the filament 104. That is, the same filament 104 can have two ends, and two different tubes 140 can receive the different ends of the same filament 104 (e.g., after the filament 104 has been wrapped around or otherwise secured to the mandrel 102). In other embodiments, the total number of filaments 104 is the same as the number of tubes 140 that house a filament 104.

Figure 2:
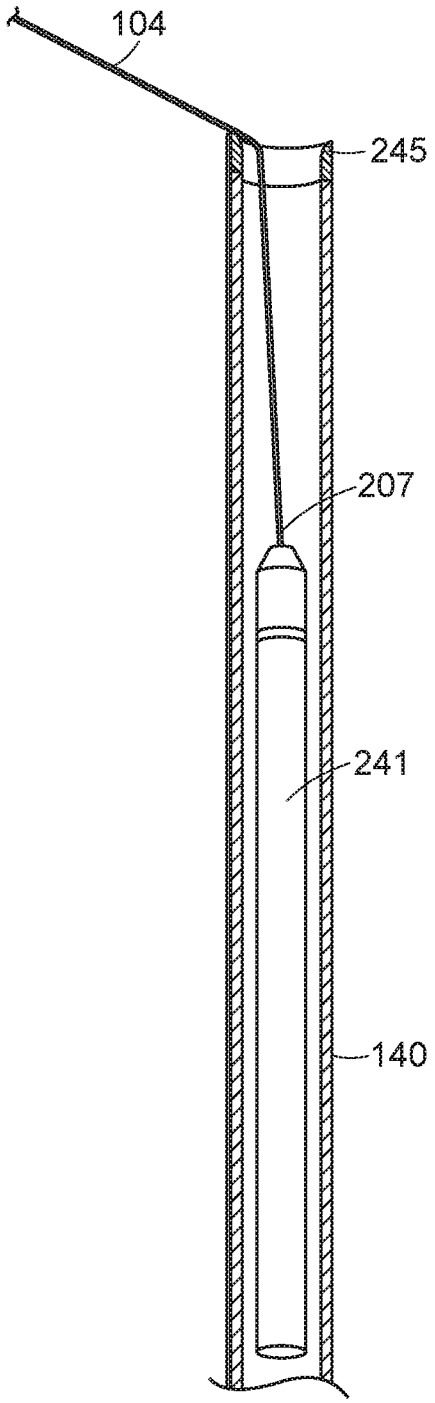
FIG. 2 is an enlarged cross-sectional view of a tube of the braiding system shown in FIG. 1 configured in accordance with embodiments of the present technology.

Each filament 104 is tensioned by a weight secured to a lower portion of the filament 104. For example, FIG. 2 is an enlarged cross-sectional view of an individual tube 140. In the embodiment illustrated in FIG. 2, the filament 104 includes an end portion 207 coupled to (e.g., tied to, wrapped around, etc.) a weight 241 positioned within the tube 140. The weight 141 can have a cylindrical or other shape and is configured to slide smoothly within the tube 140 as the filament 104 is paid out during the braiding process. The tubes 140 can further include an upper edge portion (e.g., rim) 245 that is rounded or otherwise configured to permit the filament 104 to smoothly pay out from the tube 140. The tubes 140 constrain lateral or "swinging" movement of the weights 241 and filaments 104 to inhibit significant swaying and tangling of these components along the full length of the filaments 104. This enables the system 100 to operate at higher speeds compared to systems in which filaments and/or tensioning means are non-constrained along their full lengths. Specifically, filaments that are not constrained may sway and get tangled with each other if a pause or dwell time is not incorporated into the process so that the filaments can settle. In many applications, the filaments 104 are very fine wires that would otherwise require significant pauses for settling without the full-length constraint and synchronization of the present technology. In some embodiments, the filaments 104 are all coupled to identical weights to provide for uniform tensions within the system 100. However, in other embodiments, some or all of the filaments 104 can be coupled to different weights to provide different tensions. Notably, the weights 241 may be made very small to apply a low tension on the filaments 104 and thus allow for the braiding of fine (e.g., small diameter) and fragile filaments.

Referring again to FIG. 1, and as described in further detail below with reference to FIGS. 3A and 3B, the drive units 120, 130 control the movement and location of the tubes 140. The drive units 120, 130 are configured to drive the tubes 140 in a series of discrete radial and arcuate paths relative to the central axis L that move the filaments 104 in a manner that forms a braided structure 105 (e.g., a woven tubular braid; "braid 105") on the mandrel 102. In particular, the tubes 140 each have an upper end portion 142 proximate the upper drive unit 120 and a lower end portion 144 proximate the lower drive unit 130. The drive units 120, 130 work in synchronization to simultaneously drive the upper end portion 142 and the lower end portion 144 (collectively "end portions 142, 144") of each individual tube 140 along the same path or at least a substantially similar spatial path. By driving both end portions 142, 144 of the individual tubes 140 in synchronization, the amount of sway or other undesirable movement of the tubes 140 is highly limited. As a result, the system 100 reduces or even eliminates pauses during the braiding process to allow the tubes to settle, which enables the system 100 to be operated at higher speeds than conventional systems.

In some embodiments, the drive units 120, 130 are substantially identical and include one or more mechanical connections so that they move identically (e.g., in synchronization). For example, jackshafts 113 can mechanically couple corresponding components of the inner and outer drive mechanisms of the drive units 120, 130. Similarly, in some embodiments, one of the drive units 120, 130 can be an active unit while the other of the drive units 120, 130 can be a slave unit driven by the active unit. In other embodiments, rather than a mechanical connection, an electronic control system coupled to the drive units 120, 130 is configured to move the tubes 140 in an identical sequence, spatially and temporally. In certain embodiments, where the tubes 140 are arranged conically with respect to the central axis L, the drive units 120, 130 can have the same components but with varying diameters.

In the embodiment illustrated in FIG. 1, the mandrel 102 is attached to a pull mechanism 106 configured to move (e.g., raise) the mandrel 102 along the central axis L relative to the tubes 140. The pull mechanism 106 can include a shaft 108 (e.g., a cable, string, rigid structure, etc.) that couples the mandrel 102 to an actuator or motor (not pictured) for moving the mandrel 102. As shown, the pull mechanism 106 can further include one or more guides 109 (e.g., wheels, pulleys, rollers, etc.) coupled to the frame 110 for guiding the shaft 108 and directing the force from the actuator or motor to the mandrel 102. During operation, the mandrel 102 can be raised away from the tubes 140 to extend the surface for creating the braid 105 on the mandrel 102. In some embodiments, the rate at which the mandrel 102 is raised can be varied in order to vary the characteristics of the braid 105 (e.g., to increase or decrease the braid angle (pitch) of the filaments 104 and thus the pore size of the braid 105). The ultimate length of the finished braid depends on the available length of the filaments 104 in the tubes 140, the pitch of the braid, and the available length of the mandrel 102.

In some embodiments, the mandrel 102 can have lengthwise grooves along its length to, for example, grip the filaments 104. The mandrel 102 can further include components for inhibiting rotation of the mandrel 102 relative to the central axis L during the braiding process. For example, the mandrel 102 can include a longitudinal keyway (e.g., channel) and a stationary locking pin slidably received in the keyway that maintains the orientation of the mandrel 102 as it is raised. The diameter of the mandrel 102 is limited on the large end only by the dimensions of the drive units 120, 130, and on the small end by the quantities and diameters of the filaments 104 being braided. In some embodiments, where the diameter of the mandrel 102 is small (e.g., less than about 4 mm), the system 100 can further include one or weights coupled to the mandrel 102. The weights can put the mandrel 102 under significant tension and prevent the filaments 104 from deforming the mandrel 102 longitudinally during the braiding process. In some embodiments, the weights can be configured to further inhibit rotation of the mandrel 102 and/or replace the use of a keyway and locking pin to inhibit rotation.

The system 100 can further include a bushing (e.g., ring) 117 coupled to the frame 110 via an arm 115. The mandrel 102 extends through the bushing 117 and the filaments 104 each extend through an annular opening between the mandrel 102 and the bushing 117. In some embodiments, the bushing 117 has an inner diameter that is only slightly larger than an outer diameter of the mandrel 102. Therefore, during operation, the bushing 117 forces the filaments 104 against the mandrel 102 such that the braid 105 pulls tightly against the mandrel 102. In some embodiments, the bushing 117 can have an adjustable inner diameter to accommodate filaments of different diameters. Similarly, in certain embodiments, the vertical position of the bushing 117 can be varied to adjust the point at which the filaments 104 converge to form the braid 105.

Figure 3A:
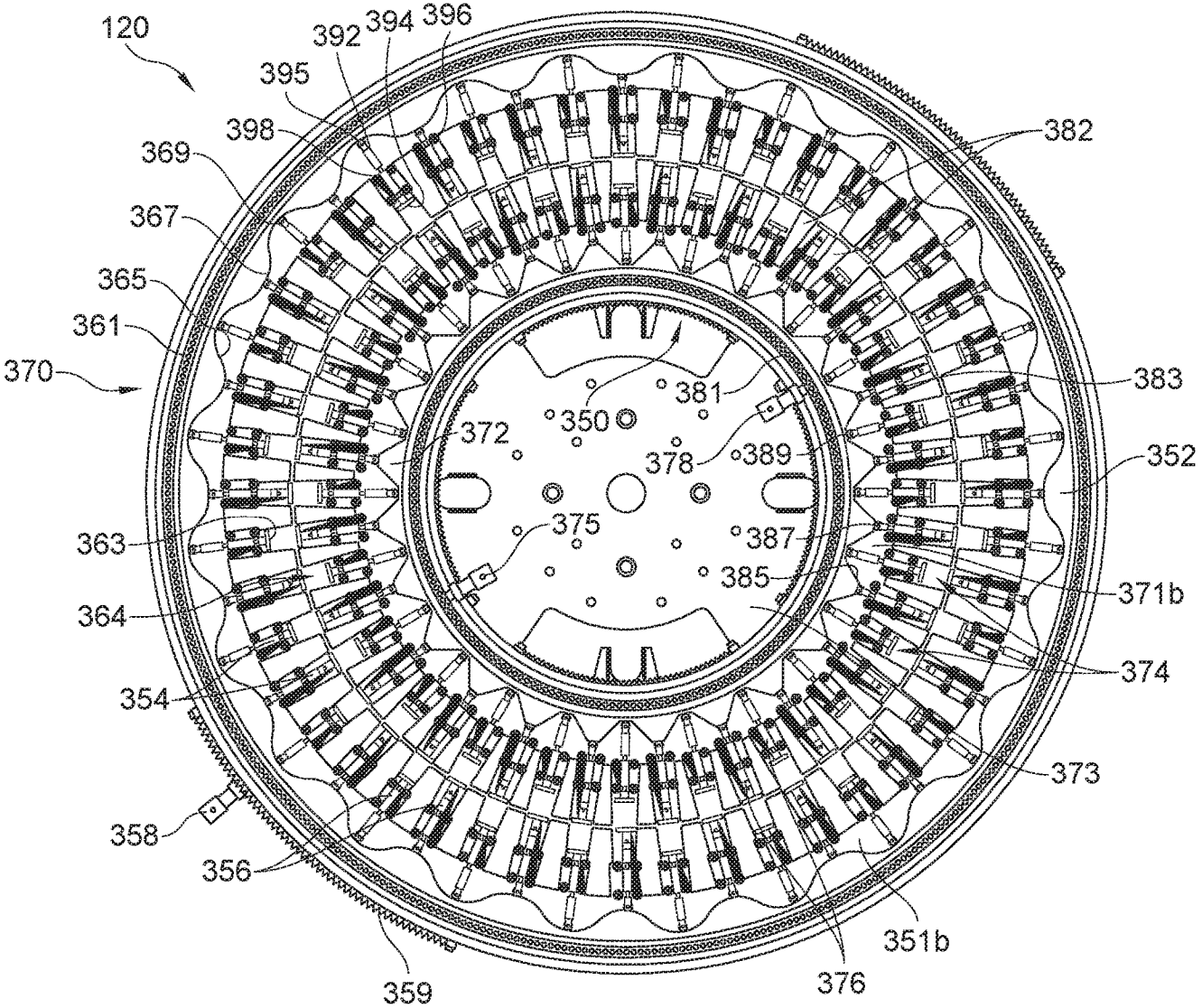
FIGS. 3A and 3B are a top view and an enlarged top view, respectively, of the upper drive unit of the braiding system shown in FIG. 1 configured in accordance with embodiments of the present technology.
Figure 3B:
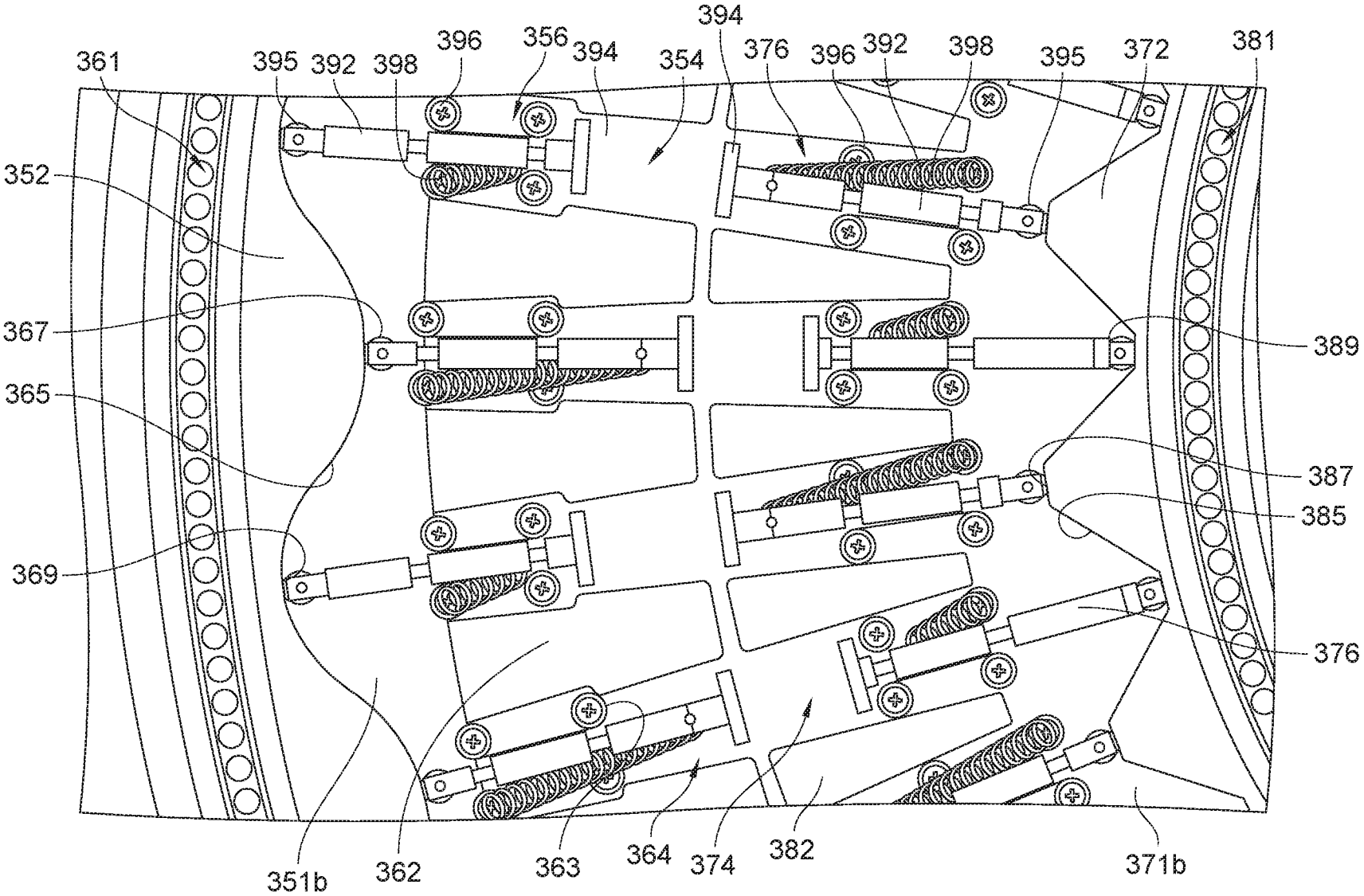

FIG. 3A is a top view of the upper drive unit 120 shown in FIG. 1 in accordance with embodiments of the present technology, and FIG. 3B is an enlarged top view of a portion of the upper drive unit 120 shown in FIG. 3A. While the upper drive unit 120 is illustrated in FIGS. 3A and 3B, the lower drive unit 130 can have substantially the same or identical components and functions as the upper drive unit 120. Accordingly, the following description can apply equally to the lower drive unit 130. Referring to FIGS. 3A and 3B together, the upper drive unit 120 includes an outer assembly 350 and an inner assembly 370 (collectively "assemblies 350, 370") arranged concentrically about the central axis L (FIG. 1). The assemblies 350, 370 include top plates which define an upper surface of the upper drive unit 120 and cover the internal components of the assemblies 350, 370. However, the upper plates of the assemblies 350, 370 are not shown in FIGS. 3A and 3B to more clearly illustrate the operation of the assemblies 350, 370.

The outer assembly 350 includes (i) outer slots (e.g., grooves) 354, (ii) outer drive members (e.g., plungers) 356 aligned with and/or positioned within corresponding outer slots 354, and (iii) an outer drive mechanism configured to move the outer drive members 356 radially inward through the outer slots 354. The number of outer slots 354 can be equal to the number of tubes 140 in the system 100, and the outer slots 354 are configured to receive a subset of the tubes 140 therein. In certain embodiments, the outer assembly 350 includes 48 outer slots 354. In other embodiments, the outer assembly 350 can have a different number of outer slots 354 such as 12 slots, 24 slots, 96 slots, or any other preferably even number of slots. The outer assembly 350 further includes a lower plate 351*b* opposite the upper plate. In some embodiments, the lower plate 351*b* can be attached to the upper support structure 116 of the frame 110.

In the embodiment illustrated in FIGS. 3A and 3B, the outer drive mechanism of the outer assembly 350 includes an outer cam ring 352 positioned between the upper and lower plates and rotatable relative to the upper and lower plates. An outer cam ring motor (e.g., an electric motor) can be configured to drive the first outer cam ring 352 to move a first set of the outer drive members 356 radially inward to thereby move a first set of the tubes 140 positioned in the outer slots 354 radially inward. More particularly, the first outer cam ring motor 358 can be coupled to one or more pinions configured to engage a track 359 on the outer cam ring 352. In some embodiments, as shown in FIG. 3A, the track 359 extends only partially around the perimeter of the outer cam ring 352. Accordingly, in such embodiments, the outer cam ring 352 is not configured to fully rotate about the central axis L. Rather, the outer cam ring 352 moves through only a relatively small arc length (e.g., about 1°-5°, about 5°-10°, or about 1020 -20°) about the central axis L. In operation, the outer cam ring 352 can be rotated in a first direction and a second direction (e.g., by reversing the motor) through the relatively small arc length. In other embodiments, the track 359 extends around a larger portion of the perimeter, such as the entire perimeter, of the outer cam ring 352, and the outer cam ring 352 can be rotated more fully (e.g., entirely) about the central axis L.

As further shown in FIGS. 3A and 3B, the lower plate 351*b* has an inner edge 363 that defines a central opening 364. A plurality of wall portions 362 are arranged circumferentially around the lower plate 351*b* and extend radially inward beyond the inner edge 363 of the lower plate 351*b*. Each pair of adjacent wall portions 362 defines one of the outer slots 354 in the central opening 364. The wall portions 362 can be fastened to the lower plate 351*b* (e.g., using bolts, screws, welding, etc.) or integrally formed with the lower plate 351*b*. In other embodiments, all or a portion of the wall portions 362 can be on the upper plate (not shown) rather than the lower plate 351*b* of the outer assembly 350.

The outer cam ring 352 includes an inner surface 365 having a periodic (e.g., oscillating) shape including a plurality of peaks 367 and troughs 369. In the illustrated embodiment, the inner surface 365 has a smooth sinusoidal shape, while in other embodiments, the inner surface 365 can have other periodic shapes such as a saw-tooth shape, trapezoidal, linear trapezoidal, or any cut pattern containing a transition between a peak and a valley (for example, any of the patterns illustrated in FIGS. 7 and 8). The outer cam ring 352 is rotatably coupled to the lower plate 351*b* such that the outer cam ring and the lower plate 351*b* can rotate with respect to each other. For example, in some embodiments, the rotatable coupling comprises a plurality of bearings disposed in a first circular channel (obscured in FIGS. 3A and 3B) formed between the lower plate 351*b* and the cam ring 352. In the illustrated embodiment, the outer cam ring 352 includes a second circular channel 361 for rotatably coupling the outer cam ring 352 to the upper plate via a plurality of bearings. In some embodiments, the first circular channel can be substantially identical to the second circular channel 361.

As further shown in FIGS. 3A and 3B, the outer drive members 356 are positioned in between adjacent wall portions 362. Each of the outer drive members 356 is identical, and each comprise a body portion 392 coupled to a push portion 394. The push portions 394 are configured to engage (e.g., contact and push) tubes positioned within the outer slots 354. The body portions 392 include a bearing 395 that contacts the periodic inner surface 365 of the outer cam ring 392. The outer drive members 356 can each be slidably coupled to a frame 396 that is attached to the lower plate 351*b*, and biasing members 398 (e.g., spring) extend between each outer drive member 356 and the corresponding frame 396. The biasing members 398 exert a radially outward biasing force against the outer drive members 356.

In operation, the outer drive members 356 are driven radially inward by rotation of the periodic inner surface 365 of the outer cam ring 352, and returned radially outward by the biasing members 398. The inner surface 365 is configured such that when the peaks 367 are radially aligned with a first set (e.g., alternating ones) of the outer drive members 356, the troughs 369 are radially aligned with a second set (e.g., the other alternating ones) of the outer drive members 356. Accordingly, as seen in FIGS. 3A and 3B, the first set of outer drive members 356 can be in a radially extended position, while the second set of outer drive members 356 are in a radially retracted position. In this position, the body portions 392 of the first set of outer drive members 356 are at or nearer to the peaks 367 than the troughs 369 of the inner surface 365, and the body portions 392 of the second set of outer drive members 356 are at or nearer to the troughs 369 than the peaks 367. To move the second set of outer drive members 356 radially inward, and move the first set of outer drive members 356 radially outward, rotation of the outer cam ring 352 moves the peaks 367 of the inner surface 365 into radial alignment with the second set of outer drive members 356. Since the outward force of the biasing members 398 urges the outer drive members 356 into continuous contact with the inner surface 365, the second set of outer drive members 356 move radially inward as the inner surface 365 rotates to align the peaks 367 with the second set of outer drive members 356. Synchronously, the radially outward biasing force of the biasing members 398 retracts the first set of outer drive members 356 into the space provided by the troughs 369.

The inner assembly 370 includes (i) inner slots (e.g., grooves) 374, (ii) inner drive members (e.g., plungers) 376 aligned with and/or positioned within corresponding ones of the inner slots 374, and (iii) an inner drive mechanism configured to move the inner drive members 376 radially outward through the inner slots 374. As shown, the number of inner slots 374 can be equal to the number of outer of outer slots 354 (e.g., 48 inner slots 374) such that the inner slots 374 can be aligned with the outer slots 354. The inner assembly 370 can further include a lower plate 371*b* that is rotatably coupled to an inner support member 373. For example, in some embodiments, the rotatable coupling comprises a plurality of bearings disposed in a circular groove formed between the inner support member 373 and the lower plate 371*b*.

In the embodiment illustrated in FIGS. 3A and 3B, the inner drive mechanism comprises an inner cam ring 372 positioned between the upper and lower plates. An inner cam ring motor 378 is configured to drive (e.g., rotate) the inner cam ring 372 to move a first set of the inner drive members 376 radially inward to thereby move a second set of the tubes 140 positioned in the inner slots 374 radially outward. The inner cam ring motor 378 can be generally similar to the outer cam ring motors 358. For example, the inner cam ring motor 378 can be coupled to one or more pinions configured to engage (e.g., mate with) a corresponding track on an inner surface the inner cam ring 372. In some embodiments, the track extends around only a portion of an inner perimeter of the inner cam ring 372, and the inner cam ring motor 378 is rotatable in a first direction and a second opposite direction to drive the inner cam ring 372 through only a relatively small arc length (e.g., about 1°-5°, about 5°-10°, or about 10°-20°) about the central axis L.

The inner assembly 370 further includes an inner assembly motor 375 configured to rotate the inner assembly 370 relative to the outer assembly 350. This rotation allows for the inner slots 374 to be rotated into alignment with different outer slots 354. The operation of the inner assembly motor 375 can be generally similar to that of the outer cam ring motor 358 and the inner cam ring motor 378.

As further shown in FIGS. 3A and 3B, the lower plate 371*b* has an outer edge 383, and the inner assembly 370 includes a plurality of wall portions 382 arranged circumferentially about the lower plate 371*b* and extending radially outward beyond the outer edge 583. Each pair of adjacent wall portions 382 defines one of the inner slots 374. The wall portions 382 can be fastened to the lower plate 371*b* (e.g., using bolts, screws, welding, etc.) or integrally formed with the lower plate 371*b*. In other embodiments, at least some of the wall portions 382 are on the upper plate rather than the lower plate 371*b* of the inner assembly 370.

The inner cam ring 372 includes an outer surface 385 having a periodic (e.g., oscillating) shape including a plurality of peaks 387 and troughs 389. In the illustrated embodiment, the outer surface 385 includes a plurality of linear ramps, while in other embodiments, the outer surface 385 can have other periodic shapes such as a smooth sinusoidal shape, saw-tooth shape, etc. (for example, any of the patterns illustrated in FIGS. 7 and 8). The inner cam ring 372 is rotatably coupled to the lower plate 371*b* by, for example, a plurality of ball bearings disposed in a first circular channel (obscured in the top views of FIGS. 3A and 3B) formed between the lower plate 371*b* and the inner cam ring 372. In the illustrated embodiment, the inner cam ring 372 includes a second circular channel 381 for rotatably coupling the inner cam ring 372 to the upper plate via, for example, a plurality of ball bearings. In some embodiments, the first circular channel can be substantially identical to the second circular channel 381. The inner cam ring 372 can accordingly rotate with respect to the upper and lower plates.

As further shown in FIGS. 3A and 3B, the inner drive members 376 are coupled to the lower plate 371*b* between adjacent wall portions 382. Each of the inner drive members 376 is identical, and the inner drive members 376 can be identical to the outer drive members 356. For example, as described above, each of the inner drive members 376 can have a body portion 392 and a push portion 394, and can be slidably coupled to frames 396 mounted to the lower plate 371*b*. Likewise, biasing members 398 extending between each inner drive member 356 and their corresponding frame 396 exert a radially inward biasing force against the inner drive members 376. As a result, the inner drive members 376 continuously contact the outer surface 385 of the inner cam ring 372.

In operation, similar to the outer drive members 356, the inner drive members 376 are driven radially outward by rotation of the periodic outer surface 385 of the inner cam ring 372, and returned radially inward by the biasing members 398. The outer surface 385 is configured such that when the peaks 387 are radially aligned with a first set (e.g., alternating ones) of the inner drive members 376, the troughs 389 are radially aligned with a second set (e.g., the other alternating ones) of the inner drive members 376. Accordingly, as seen in FIGS. 3A and 3B, the first set of inner drive members 376 can be in a radially extended position, while the second set of inner drive members 376 are in a radially retracted position. In this position, the body portions 392 of the first set of inner drive members 376 are at or nearer to the peaks 387 than the troughs 389 of the outer surface 385, and the body portions 392 of the second set of inner drive members 376 are at or nearer to the troughs 389 than the peaks 387. To move the second set of inner drive members 376 radially outward, and move the first set of inner drive members 376 radially inward, rotation of the inner cam ring 372 moves the peaks 387 of the outer surface 385 into radial alignment with the second set of inner drive members 376. Since the inward force of the biasing members 398 urges the inner drive members 376 into continuous contact with the outer surface 385, the second set of inner drive members 376 move radially outward as the outer surface 385 rotates to align the peaks 387 with the second set of inner drive members 376. Synchronously, the radially inward biasing force of the biasing members 398 retracts the first set of inner drive members 376 into the space provided by the troughs 389.

As illustrated in FIGS. 3A and 3B, the assemblies 350, 370 are configured such that when an outer drive member 356 is in an extended position, an aligned inner drive member 376 is correspondingly in a retracted position. In this manner, the assemblies 350, 370 maintain a constant amount of space for the tubes 140. This keeps the tubes 140 moving in a discrete, predictable pattern determined by a control system of the system 100.

Notably, each of the drive members in the system 100 is actuated by the rotation of a cam ring that provides a consistent and synchronized actuation force to all of the drive members. In contrast, in conventional systems where filaments are actuated individually or in small sets by separately controlled actuators, if one actuator is out of synchronization with another, there is a possibility of tangling of filaments. Moreover, because the number of inner slots 374 and outer slots 354 is the same, half the tubes can be passed from the inner slots 374 to the outer slots 354, and vice versa, simultaneously. Likewise, the use of a single cam ring for actuating all of the outer drive members, and a single cam ring for actuating all of the inner drive members, significantly simplifies the design. In other configurations, the inner and outer cams can each contain multiple individually controlled plates: one cam per set per inner/outer assembly. Using multiple cams per inner/outer assembly allows increased control of tube movement and timing. These alternative configurations would also allow for both sets to be entirely loaded into either the inner or outer ring all at once, if necessary (as shown in, for example, FIGS. 5 and 6).

The lower drive unit 130 has components and functions that are substantially the same as or identical to the upper drive unit 120 described in detail above with reference to FIG. 3. The inner drive mechanisms (e.g., inner cam rings) of the drive units 120, 130 move in a substantially identical sequence both spatially and temporally to drive the upper portion and lower portion of each individual tube 140 along the same or a substantially similar spatial path. Likewise, the outer drive mechanisms (outer cam rings) of the drive units 120, 130 move in a substantially identical sequence both spatially and temporally.

In general, the upper drive unit 120 is configured to drive a first set of the tubes 140 in three distinct movements: (i) radially inward (e.g., from the outer slots 354 to the inner slots 374) via rotation of the outer cam ring 352 of the outer assembly 350; (ii) radially outward (e.g., from the inner slots 374 to the outer slots 354) via rotation of the inner cam ring 372 of the inner assembly 370; and (iii) circumferentially relative to a second set of the tubes 140 via rotation of the inner assembly 370. Moreover, as explained in more detail below with reference to FIG. 9, in some embodiments these movements can be mechanically independent and a system controller (not pictured; e.g., a digital computer) can receive input from a user via a user interface indicating one or more operating parameters for these movements as well as the movement of the mandrel 102 (FIG. 1). For example, the system controller can drive each of the three motors in the drive units 120, 130 (e.g., the outer cam ring motor 358, the inner cam ring motor 378, and the inner assembly motor 375) with closed loop shaft rotation feedback. The system controller can relay the parameters to the various motors (e.g., via a processor), thereby allowing manual and/or automatic control of the movements of the tubes 140 and the mandrel 102 to control formation of the braid 105. In this way the system 100 can be parametric and many different forms of braid can be made without modification of the system 100. In other embodiments, the various motions of the drive units 120, 130 are mechanically sequenced such that turning a single shaft indexes the drive units 120, 130 through an entire cycle.

FIGS. 4A-4E are schematic views more particularly showing the movement of eight tubes 140 within the upper drive unit 120 at various stages in a method of forming a braided structure (e.g., the braid 105) in accordance with embodiments of the present technology. While reference is made to the movement of the tubes within the upper drive unit 120, the illustrated movement of the tubes is substantially the same in the lower drive unit 130 since the motions and components of the drive units 120, 130 are identical. Moreover, while only eight tubes are shown in FIGS. 4A-4E for ease of explanation and understanding, one skilled in the art will readily understand that the movement of the eight tubes is representative of any number of tubes (e.g., 24 tubes, 48 tubes, 96 tubes, or other numbers of tubes).

Figure 4A:
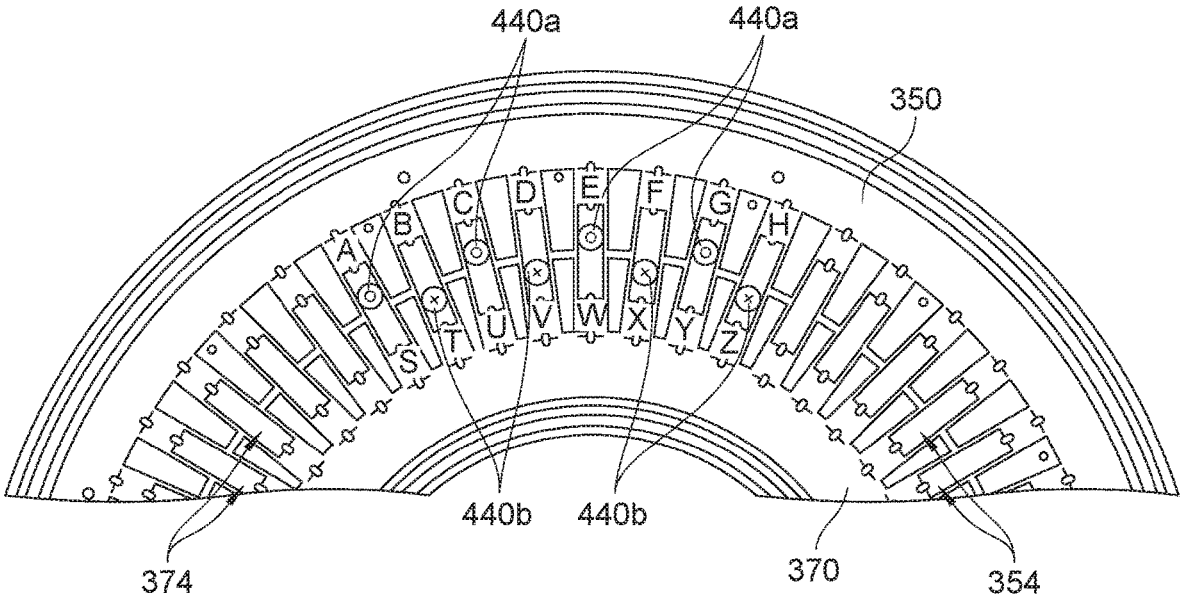
FIGS. 4A-4E are enlarged, schematic views of the upper drive unit shown in FIGS. 3A and 3B at various stages in a method of forming a braided structure configured in accordance with embodiments of the present technology.

Referring first to FIG. 4A, the system 100 is an initial position in which (i) the outer assembly 350 contains a first set of tubes 440*a* (each labeled with an "X"), and the (ii) the inner assembly 370 contains a second set of tubes 440*b* (each labeled with an "O"). The first set of tubes 440*a* are positioned within alternating ones of the outer slots 354 (e.g., in the outer slots 354 labeled A, C, E, and G), and the second set of tubes 440*b* are positioned within alternating ones of the inner slots 374 (e.g., in the inner slots labeled T, V, X, and Z). As shown, the first set of tubes 440*a* are radially aligned with empty ones of the inner slots 374 (e.g., with the inner slots 374 labeled S, U, W, and Y). Similarly, the second set of tubes 440*b* are radially aligned with empty ones of the outer slots 354 (e.g., with the outer slots labeled B, D, F, and H). The reference numerals "X" for the first set of tubes 440*a*, "O" for the second set of tubes 440*b*, "A-H" for the outer slots 354, and "S-Z" for the inner slots 374 are reproduced in each of FIGS. 4A-4E in order to illustrate the relative movement of assemblies 350, 370.

Figure 4B:
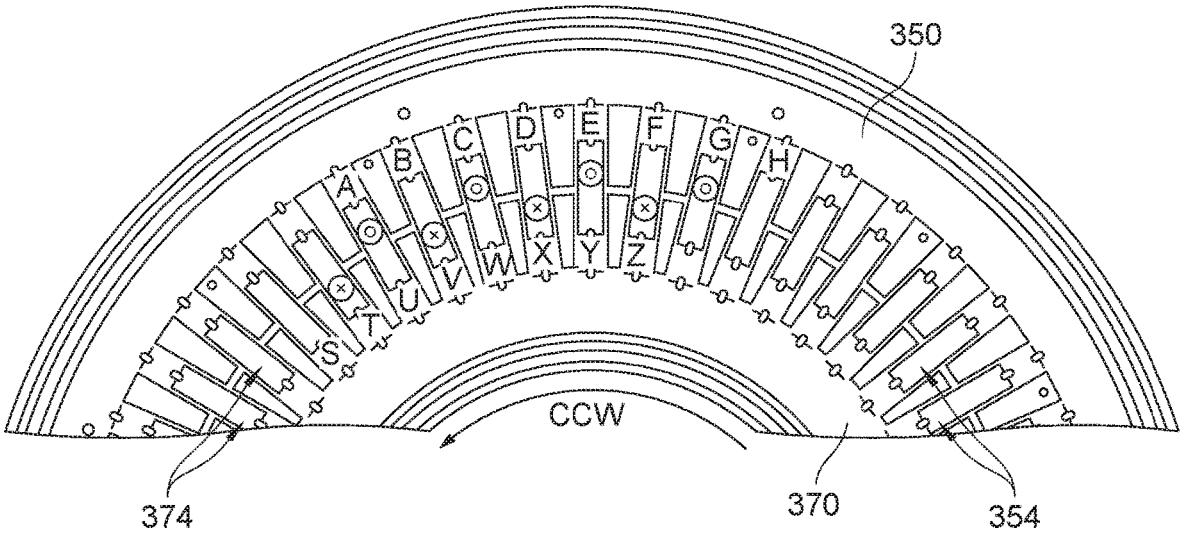

Referring next to FIG. 4B, the inner assembly 370 is rotated in a first direction (e.g., in the counterclockwise direction indicated by the arrow CCW) to align the second set of tubes 440*b* with a different set of outer slots 354. In the embodiment illustrated in FIG. 4B, the inner assembly 370 rotates relative to the outer assembly 350 to align each tube in the second set of tubes 440*b* with the next available outer slot 354 that is empty—i.e., an outer slot 354 that is two slots away. For example, while the inner slot 374 labeled X was initially aligned with the empty outer slot 374 labeled F (FIG. 4A), after rotation, the inner slot 374 labeled X is aligned with the empty outer slot 354 labeled D. This step passes the filaments in the second set of tubes 440*b* under the filaments in the first set of tubes 440*a* to create the weave pattern of the cylindrical braid. In some embodiments, the inner assembly 370 can be rotated to align the second set of tubes 440*b* with empty ones of the outer slots 354 that are not the next available empty outer slot 354 (e.g., outer slots 354 that are four slots away, six slots away, etc.). The number of empty outer slots 354 skipped during rotation of the inner assembly 370 determines the weave pattern of the resulting braid (e.g., 1 over 1, 1 over 2, 2 over 2, etc.). In some embodiments, instead of rotating the inner assembly 370, the outer assembly 350 is rotated. In some embodiments, the drive unit can rotate one of the sets of tubes only one or two empty spaces in either direction during a single rotation. Nevertheless, if required, the program controlling the system 100 can achieve any number of passed spaces with multiple drop-offs and pick-ups of the same set, repeatedly. In other configurations, the drive units can be designed to mechanically achieve the same increase in rotational travel without programming assistance.

Figure 4C:
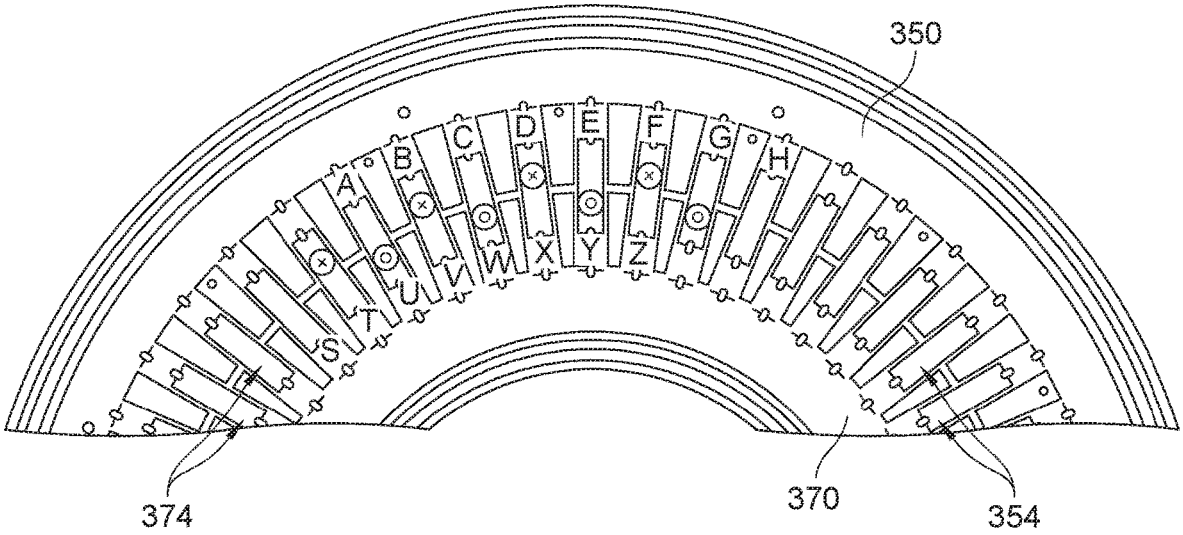

Referring next to FIG. 4C, the first and second set of tubes 440*a*, 440*b* are "passed" by each other. More particularly, the first set of tubes 440*a* are moved radially inward from the outer slots 354 to the inner slots 374, and the second set of tubes 440*b* are simultaneously or substantially simultaneously moved radially outward from the inner slots 374 to the outer slots 354. For example, as described with reference to FIGS. 3A and 3B, a first set of outer drive members 354 of the outer assembly 350 can be driven radially inward by the outer cam ring 352 to move the first set of tubes 440*a* from the outer slots 354 to the inner slots 374. At the same time, a first set of inner drive members 376 of the inner assembly 370 can be retracted radially inward to provide space for the first set of tubes 440*a*. Likewise, a second set of inner drive members 376 of the inner assembly can be driven radially outward by the inner cam ring 372 to move the second of tubes 440*b* from the inner slots 374 to the outer slots 354. At the same time, a second set of outer drive members 356 can be retracted radially outward to provide space for the second set of tubes 440*b*.

Figure 4D:
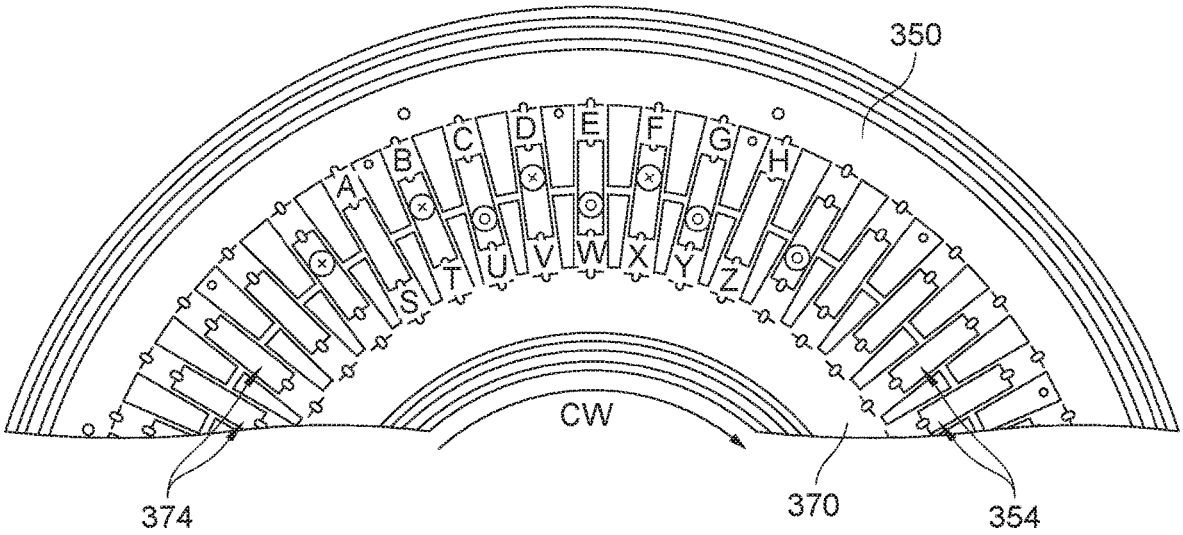

Next, as shown in FIG. 4D, the inner assembly 370 is rotated in a second direction (e.g., in the clockwise direction indicated by the arrow CW) to align the first set of tubes 440*a* with a different set of outer slots 354. In the embodiment illustrated in FIG. 4D, the inner assembly 370 rotates relative to the outer assembly 350 to align each tube in the first set of tubes 440*a* with the next available outer slot 354 that is empty—i.e., an outer slot 354 that is two slots away. For example, while the inner slot 374 labeled W was initially aligned with the empty outer slot 374 labeled C (FIG. 4C), after rotation, the inner slot 374 labeled W is aligned with the empty outer slot 354 labeled E. This step passes the filaments in the first set of tubes 440*a* under the filaments in the second set of tubes 440*b* to create the weave pattern of the cylindrical braid. In some embodiments, the amount of rotation can vary (e.g., rotation by more than one empty outer slot 354). In the illustrated embodiment, after rotation, the inner assembly 370 and outer assembly 350 are in the initial or starting position, as illustrated in FIG. 4A.

Figure 4E:
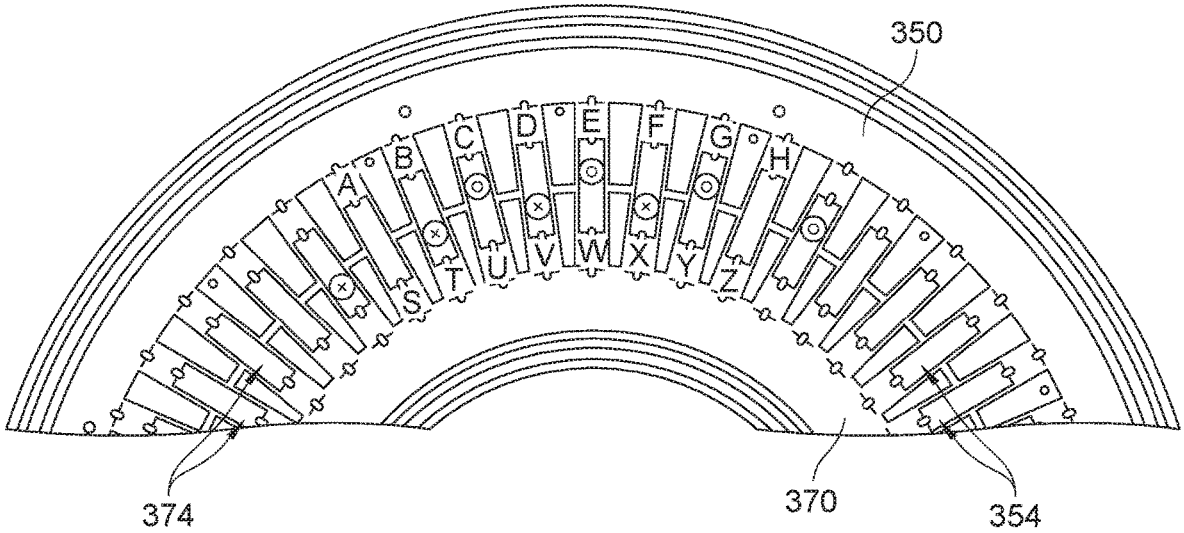

Finally, referring to FIG. 4E, the first and second set of tubes 440*a*, 440*b* are "passed" by each other. More particularly, the second set of tubes 440*b* are moved radially inward from the outer slots 354 to the inner slots 374, and the first set of tubes 440*a* are simultaneously or substantially simultaneously moved radially outward from the inner slots 374 to the outer slots 354. As shown, each tube in the first set of tubes 440*a* has been rotated in the first direction (e.g., rotated two outer slots 354 in the clockwise direction) relative to the initial position shown in FIG. 4A, and each tube in the second set of tubes 440*b* has been rotated in the second direction (e.g., rotated two inner slots 374 in the counterclockwise direction) relative to the initial position of FIG. 4A.

The steps illustrated in FIGS. 4A-4E can subsequently be repeated to form a cylindrical braid on the mandrel as the first and second sets of tubes 440*a*, 440*b* —and the filaments held therein—are repeatedly passed by each other, rotating in opposite directions, sequentially alternating between radially outward passes relative to the other set and radially inward passes relative to the other set. One skilled in the art will recognize that the direction of rotation, the distance of each rotation, etc., can be varied without departing from the scope of the present technology.

Figure 5:
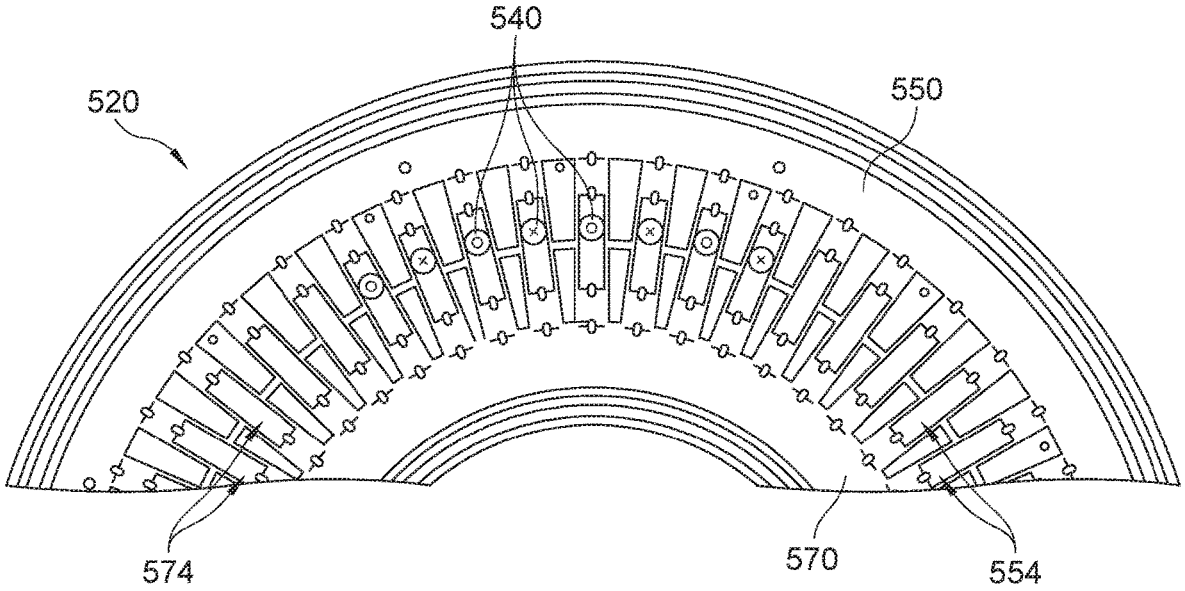
FIGS. 5 and 6 are enlarged schematic views of a drive unit of a braiding system configured in accordance with embodiments of the present technology.
Figure 6:
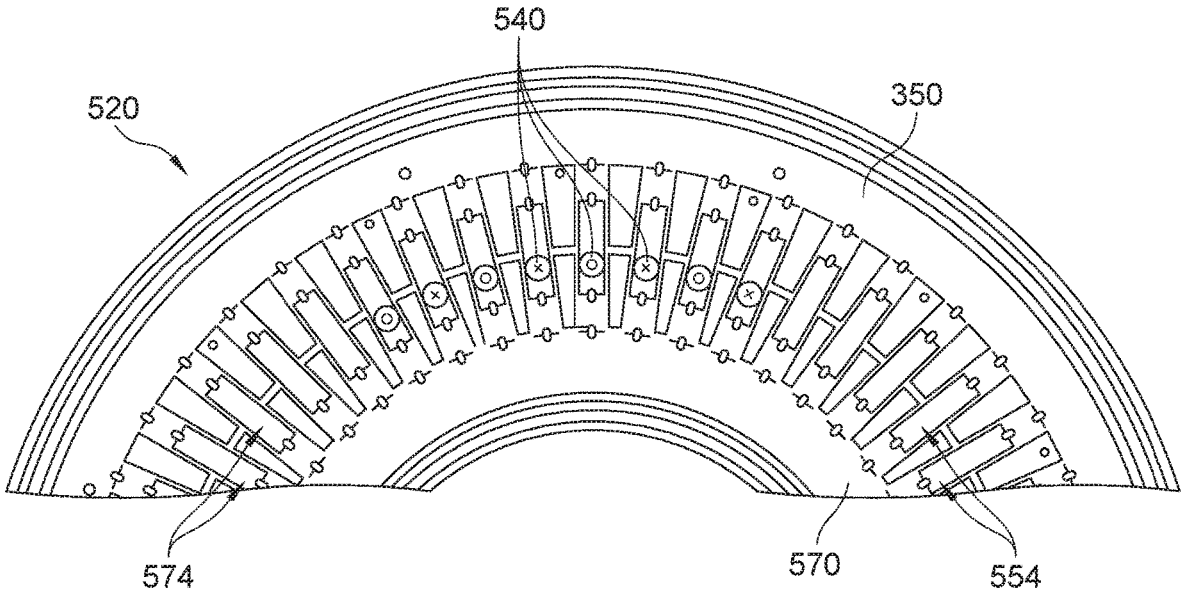

FIGS. 5 and 6 are schematic views of a drive unit 520 (e.g., an upper or lower drive unit) of a braiding system configured in accordance with another embodiment of the present technology. The drive unit 520 can include features generally similar to the drive units 120, 130 described in detail above with reference to FIGS. 1-4E. For example, the drive unit 520 includes an outer assembly 550 and inner assembly 570 (collectively "assemblies 550, 570") arranged coaxially within the outer assembly 550. Likewise, the outer assembly 550 can have outer slots 554, the inner assembly 570 can have inner slots 574, and tubes 540 can be constrained within individual ones of the outer slots 554 and/or inner slots 574. In the illustrated embodiment, however, the assemblies 550, 570 each include multiple cam rings (not pictured) that can be individually controlled and/or mechanically synchronized to permit all of the tubes 540 to be positioned within the outer slots 554 (e.g., as shown in FIG. 5) or within the inner slots 574 (e.g., as shown in FIG. 6). Actuation of the multiple cam rings can simultaneously or discretely move the tubes 540 between the inner and outer slots 554, 574. In some embodiments, using multiple cams per inner/outer assembly allows increased control of tube movement and timing.

Figure 7:
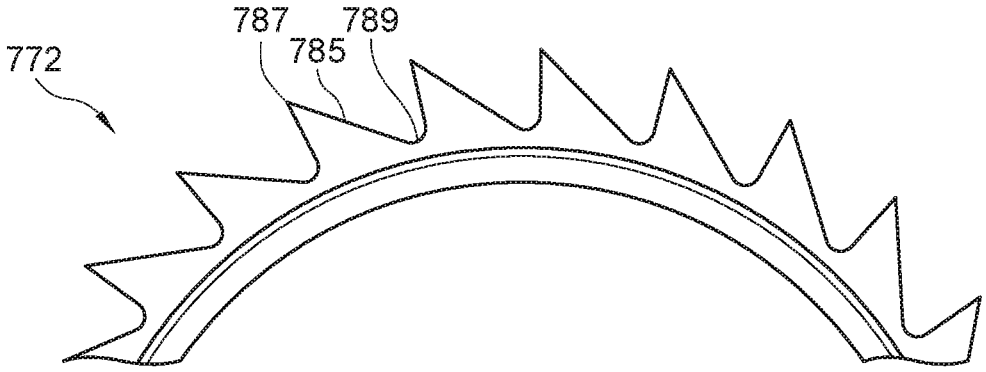
FIGS. 7 and 8 are enlarged top views of cam rings configured in accordance with embodiments of the present technology.
Figure 8:
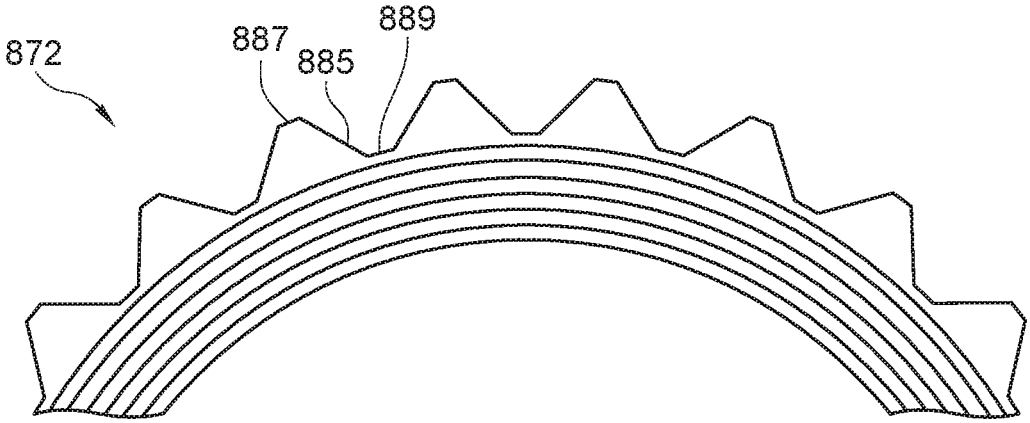

As described above, cam rings in accordance with the present technology can have various periodic shapes for driving the drive members radially inward or outward. FIG. 7, for example, is an enlarged top view of a cam ring 772 (e.g., an inner cam ring) having an outer surface 785 having a generally saw-tooth periodic shape including a plurality of (e.g., sharp, pointed, etc.) peaks 787 and troughs 789. FIG. 8, for example, is an enlarged top view of a cam ring 872 (e.g., an inner cam ring) having an outer surface 885 having a generally triangular or linear shape including a plurality of (e.g., blunted, flat, etc.) peaks 887 and troughs 889. In other embodiments, cam rings in accordance with the present technology can other suitable periodic or non-periodic shapes for actuating the drive members.

Figure 9:
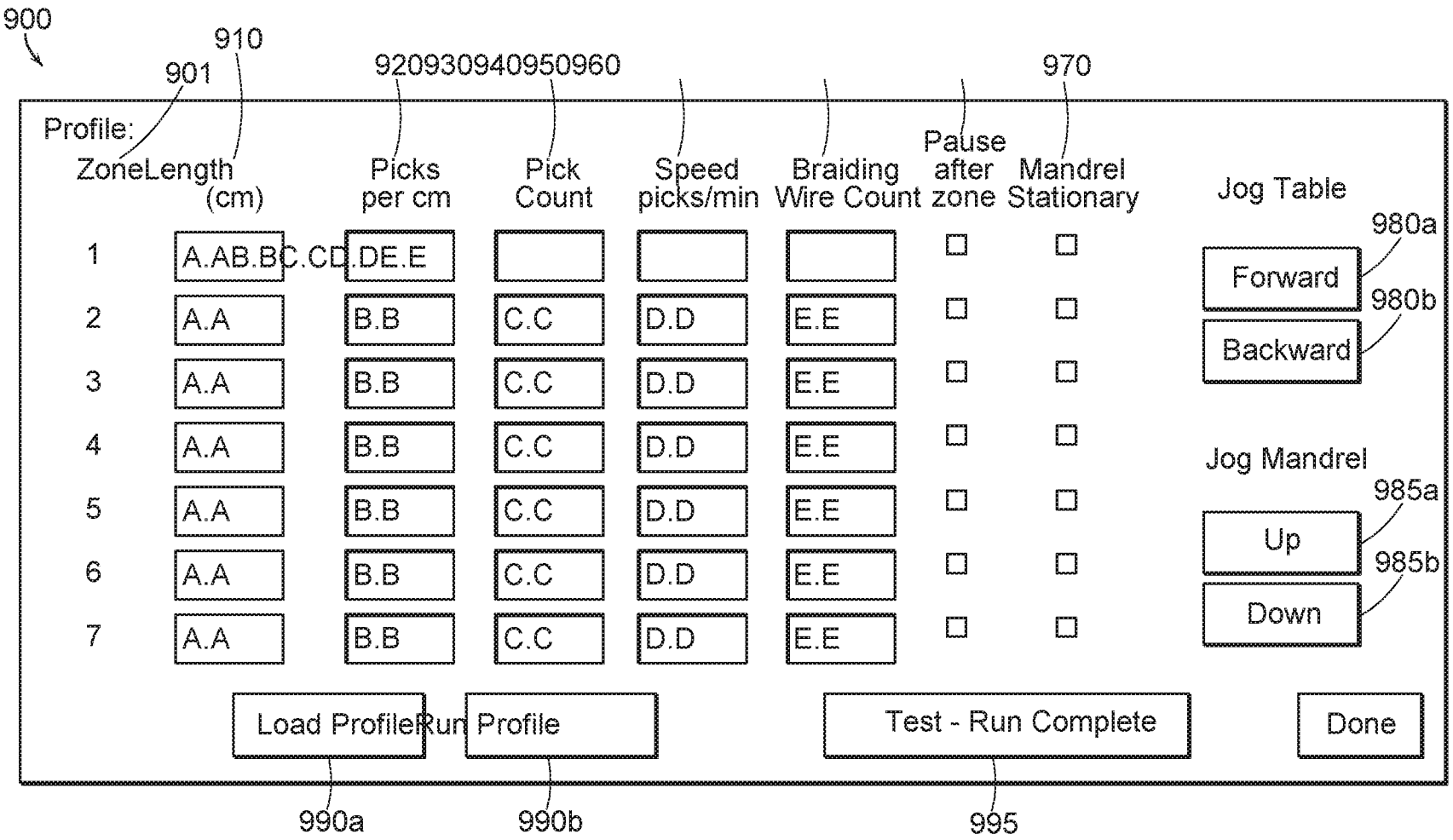
FIG. 9 is a display of user interface for a braiding system controller configured in accordance with embodiments of the present technology.

FIG. 9 is a screenshot of a user interface 900 that can be used to control the system 100 (FIG. 1) and the characteristics of the resulting braid 105 formed on the mandrel 102. A plurality of clickable, pushable, or otherwise engageable buttons, indicators, toggles, and/or user elements is shown within the user interface 900. For example, the user interface 900 can include a plurality of elements each indicating a desired and/or expected characteristic for the resulting braid 105. In some embodiments, characteristics can be selected for one or more zones (e.g., the 7 illustrated zones) each corresponding to a different vertical portion of the braid 105 formed on the mandrel 102. More particularly, elements 910 can indicate a length for the zone along the length of the mandrel or braid (e.g., in cm), elements 920 can indicate a number of picks (a number of crosses) per cm, elements 930 can indicate a pick count (e.g., a total pick count), elements 940 can indicate a speed for the process (e.g., in picks formed per minute), and elements 950 can indicate a braiding wire count. In some embodiments, if the user inputs a specific characteristic for a zone, some or all of the other characteristics may be constrained or automatically selected. For example, a user input of a certain number of "picks per cm" and zone "length" may constrain or determine the possible number of "picks per cm." The user interface can further include selectable elements 960 for pausing of the system 100 after the braid 105 has been formed in a certain zone, and selectable elements 970 for keeping the mandrel stationary during the formation of a particular zone (e.g., to permit manual jogging of the mandrel 102 rather than automatic). In addition, the user interface can include elements 980*a* and 980*b* for jogging the table, elements 985*a* and 985*b* for jogging (e.g., raising or lowering) the mandrel 102 up or down, respectively, elements 990*a* and 990*b* for loading a profile (e.g., a set of saved braid characteristics) and running a selected profile, respectively, and an indicator 995 for indicating that a run (e.g., all or a portion of a braiding process) is complete.

Figure 10:
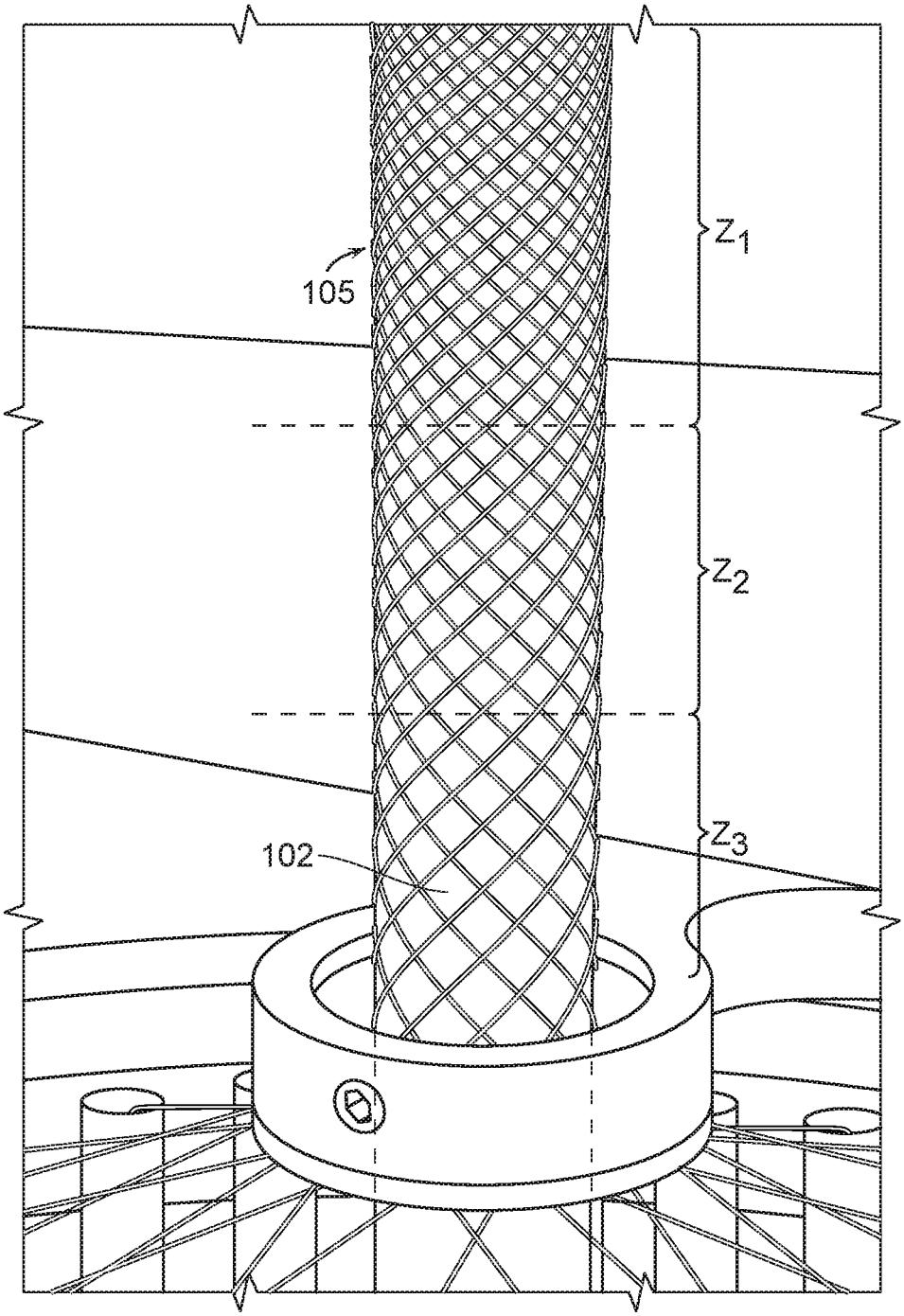
FIG. 10 is an isometric of a portion of a mandrel of the braiding system shown in FIG. 1 configured in accordance with embodiments of the present technology.

In some embodiments, for example, lower pick counts improve flexibility, while higher pick counts increases longitudinal stiffness of the braid 105. Thus, the system 100 advantageously permits for the pick count (and other characteristics of the braid 105) to be varied within a specific length of the braid 105 to provide variable flexibility and/or longitudinal stiffness. For example, FIG. 10 is an enlarged view of the mandrel 102 and the braid 105 formed thereon. The braid 105 or mandrel 102 can include a first zone Z1, a second zone Z2, and a third zone Z3 each having different characteristics. As shown, for example, the first zone Z1 can have a higher pick count than the second and third zones Z2 and Z3, and the second zone Z2 can have a higher pick count than third zone Z3. The braid 105 can therefore have a varying flexibility—as well as pore size—in each zone.

EXAMPLES

Several aspects of the present technology are set forth in the following examples.

1. A braiding system, comprising:
a drive unit including—
an outer assembly including an outer cam and outer slots;
an inner assembly including an inner cam and inner slots, wherein the inner assembly is coaxially aligned with the outer assembly, and wherein the number of inner and outer slots is the same;
a plurality of tubes, wherein individual ones of the tubes are constrained within individual ones of the inner and/or outer slots;
an outer drive mechanism configured to rotate the outer cam to drive a first set of the tubes from the outer slots to the inner slots; and
an inner drive mechanism configured to rotate the inner cam to drive a second set of the tubes from the inner slots to the outer slots.

2. The braiding system of example 1 wherein—
when the first set of tubes is constrained within the outer slots, the second set of tubes is constrained within the inner slots; and
when the first set of tubes is constrained within the inner slots, the second set of tubes is constrained within the outer slots.

3. The braiding system of example 1 or 2 wherein the inner and outer drive mechanisms are configured to rotate the inner and outer cams to substantially simultaneously (a) drive the first set of the tubes from the outer slots to the inner slots and (b) drive the second set of the tubes from the inner slots to the outer slots.

4. The braiding system of any one of examples 1-3 wherein—
the outer assembly includes outer drive members aligned with the outer slots;
the inner assembly includes inner drive members aligned with the inner slots;
the outer drive mechanism is configured to rotate the outer cam to move the outer drive members radially inward; and
the inner drive mechanism is configured to rotate the inner cam to move the inner drive members radially outward.

5. The braiding system of example 4 wherein—
a first rotational movement of the outer cam moves a first set of the outer drive members radially inward; and
a second rotational movement of the outer cam moves a second set of the outer drive members radially inward.

6. The braiding system of example 5 wherein the first and second sets of the outer drive members include the same number of outer drive members.

7. The braiding system of any one of examples 4-6 wherein—
a first rotational movement of the inner cam moves a first set of the inner drive members radially outward; and
a second rotational movement of the inner cam moves a second set of the inner drive members radially outward.

8. The braiding system of any one of examples 4-7 wherein the first and second sets of the inner drive members include the same number of inner drive members.

9. The braiding system of any one of examples 4-8 wherein—
the outer cam has a radially-inward facing surface with a periodic shape that is in continuous contact with the outer drive members; and
the inner cam has a radially-outward facing surface with a periodic shape that is in continuous contact with the inner drive members.

10. The braiding system of any one of examples 1-9 wherein the inner and outer assemblies are substantially coplanar, and wherein the inner assembly is rotatable relative to the outer assembly.

11. A method of forming a tubular braid, the method comprising:

rotating an inner assembly relative to an outer assembly, wherein the inner assembly constrains a first set of elongate members, wherein the outer assembly constrains a second of elongate members, and wherein individual ones of the first and second elongate members are configured to receive individual filaments; and substantially simultaneously— driving an inner cam of the inner assembly to move the first set of elongate members from the inner assembly to the outer assembly; and driving an outer cam of the outer assembly to move the second set of elongate members from the outer assembly to the inner assembly.

12. The method of example 11 further comprising, after substantially simultaneously driving the inner and outer cams, rotating the inner assembly to rotate the second set of elongate members relative to the first set of elongate members.

13. The method of example 11 or 12 wherein rotating the inner assembly includes rotating the inner assembly in a first direction to rotate the first set of elongate members relative to the second set of elongate members, and wherein the method further comprises:

after substantially simultaneously driving the inner and outer cams, rotating the inner assembly in a second direction to rotate the second set of elongate members relative to the first set of elongate members, wherein the first direction is opposite to the second direction.

14. The method of any one of examples 11-13 wherein— the inner assembly includes inner slots configured to constrain the first set or the second set of the elongate members;

the outer assembly includes outer slots configured to constrain the first set or the second set of the elongate members; and the number of inner and outer slots is the same.

15. A braiding system, comprising:

a plurality of elongate members each having an upper portion and a lower portion, wherein individual ones of the elongate members are configured to receive individual filaments;

an upper drive unit configured to act against the upper portions of the elongate members; and a lower drive unit coaxially aligned with the upper drive unit along a longitudinal axis and configured to act against the lower portions of the elongate members, wherein the upper and lower drive units are configured to act against the upper and lower portions of the elongate members in synchronization to simultaneously drive (a) a first set of the elongate members radially inward toward the longitudinal axis and (b) a second set of the elongate members radially outward away from the longitudinal axis.

16. The braiding system of example 15 wherein the upper drive unit constrains the upper portions of the elongate members, and wherein the lower drive unit constrains the lower portions of the elongate members.

17. The braiding system of example 15 or 16 wherein the upper and lower drive units are further configured to move the elongate members along an arcuate path with respect to the longitudinal axis.

18. The braiding system of any one of examples 15-17 wherein the upper and lower drive units are substantially identical.

19. The braiding system of any one of examples 15-18 wherein the upper and lower drive units are mechanically synchronized to move together.

20. The braiding system of any one of examples 15-19 wherein— the upper drive unit includes (a) an outer assembly having outer slots and (b) an inner assembly having inner slots;

the lower drive unit includes (a) an outer assembly having outer slots and (b) an inner assembly having inner slots;

individual ones of the elongate members are constrained within individual ones of the inner and/or outer slots of the upper and lower drive units; and the number of inner and outer slots is the same.

Conclusion

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology as those skilled in the relevant art will recognize. For example, although steps are presented in a given order, alternative embodiments may perform steps in a different order. The various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

We claim:

1. A braiding system, comprising:

a drive unit including an outer assembly including an outer cam, outer slots, and outer drive members aligned with the outer slots;

an inner assembly including an inner cam, inner slots, and inner drive members aligned with the inner slots, wherein the inner assembly is coaxially aligned with the outer assembly, and wherein the number of inner and outer slots is the same;

a plurality of tubes, wherein individual ones of the tubes are constrained within individual ones of the inner and/or outer slots;

an outer drive motor configured to rotate the outer cam to move the outer drive members radially inward to drive a first set of the tubes from the outer slots to the inner slots; and an inner drive motor configured to rotate the inner cam to move the inner drive members radially outward to drive a second set of the tubes from the inner slots to the outer slots, wherein the inner and outer drive motors are configured to rotate the inner and outer cams to simultaneously (a) move the outer drive members radially inward to drive the first set of the tubes from the outer slots to the inner slots and (b) move the inner drive members radially outward to drive the second set of the tubes from the inner slots to the outer slots.

2. The braiding system of claim 1 wherein— when the first set of tubes is constrained within the outer slots, the second set of tubes is constrained within the inner slots; and when the first set of tubes is constrained within the inner slots, the second set of tubes is constrained within the outer slots.

3. The braiding system of claim 1 wherein— a first rotational movement of the outer cam moves a first set of the outer drive members radially inward; and a second rotational movement of the outer cam moves a second set of the outer drive members radially inward.

4. The braiding system of claim 3 wherein the first and second sets of the outer drive members include the same number of outer drive members.

5. The braiding system of claim 1 wherein— a first rotational movement of the inner cam moves a first set of the inner drive members radially outward; and a second rotational movement of the inner cam moves a second set of the inner drive members radially outward.

6. The braiding system of claim 5 wherein the first and second sets of the inner drive members include the same number of inner drive members.

7. The braiding system of claim 1 wherein— the outer cam has a radially-inward facing surface with a periodic shape that is in continuous contact with the outer drive members; and the inner cam has a radially-outward facing surface with a periodic shape that is in continuous contact with the inner drive members.

8. The braiding system of claim 1 wherein the inner and outer assemblies are substantially coplanar, and wherein the inner assembly is rotatable relative to the outer assembly.

9. The braiding system of claim 1, further comprising:

a plurality of weights positioned within corresponding ones of the tubes;

wherein individual ones of the tubes are configured to receive individual filaments; and wherein the weights are configured to be secured to corresponding ones of the filaments within the tubes.

10. A method of forming a tubular braid, the method comprising:

rotating an inner assembly relative to an outer assembly, wherein the inner assembly constrains a first set of elongate members, wherein the outer assembly constrains a second set of the elongate members, and wherein individual ones of the elongate members in the first set and individual ones of the elongate members in the second set are configured to receive individual filaments; and simultaneously— rotating an inner cam of the inner assembly to move a plurality of outer drive members radially inward to move the first set of elongate members from the inner assembly to the outer assembly; and rotating an outer cam of the outer assembly to move a plurality of inner drive members radially outward to move the second set of elongate members from the outer assembly to the inner assembly.

11. The method of claim 10 further comprising, after simultaneously rotating the inner and outer cams, rotating the inner assembly to rotate the second set of elongate members relative to the first set of elongate members.

12. The method of claim 10 wherein rotating the inner assembly includes rotating the inner assembly in a first direction to rotate the first set of elongate members relative to the second set of elongate members, and wherein the method further comprises:

after simultaneously rotating the inner and outer cams, rotating the inner assembly in a second direction to rotate the second set of elongate members relative to the first set of elongate members, wherein the first direction is opposite to the second direction.

13. The method of claim 10 wherein— the inner assembly includes inner slots configured to constrain the first set or the second set of the elongate members;

the outer assembly includes outer slots configured to constrain the first set or the second set of the elongate members; and the number of inner and outer slots is the same.

* * * * *